US010501225B2

(12) United States Patent
Kelley et al.

(10) Patent No.: US 10,501,225 B2
(45) Date of Patent: Dec. 10, 2019

(54) CONTAINER HANDLING SYSTEM

(71) Applicant: Graham Packaging Company, L.P., York, PA (US)

(72) Inventors: Paul Kelley, Wrightsville, PA (US); Kent Goss, Louisburg, KS (US); Philip Sheets, York, PA (US); Ted Lyon, Shenandoah, PA (US); Charles A. Ryl-Kuchar, Bolingbrook, IL (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 148 days.

(21) Appl. No.: 14/744,856

(22) Filed: Jun. 19, 2015

(65) Prior Publication Data

US 2015/0284128 A1 Oct. 8, 2015

Related U.S. Application Data

(60) Division of application No. 12/354,327, filed on Jan. 15, 2009, now Pat. No. 9,090,363, which is a (Continued)

(51) Int. Cl.
*B65D 1/02* (2006.01)
*B65D 1/40* (2006.01)

(Continued)

(52) U.S. Cl.
CPC ..... *B65D 1/0246* (2013.01); *B65B 9/042* (2013.01); *B65B 21/12* (2013.01); *B65B 61/24* (2013.01);

(Continued)

(58) Field of Classification Search
CPC ..... B65D 1/0246; B65D 1/0261; B65D 1/40

(Continued)

(56) References Cited

U.S. PATENT DOCUMENTS 1,499,239 A 6/1924 Malmquist
2,142,257 A 1/1937 Saeta (Continued)

FOREIGN PATENT DOCUMENTS

AU 2002257159 B2 4/2003
CA 2077717 A1 3/1993

(Continued)

OTHER PUBLICATIONS

U.S. Appl. No. 13/210,350, filed Aug. 15, 2011, Wurster, et al.

(Continued)

*Primary Examiner* — Jeffrey R Allen
*Assistant Examiner* — Jennifer Castriotta
(74) *Attorney, Agent, or Firm* — Baker Botts L.L.P.

(57) ABSTRACT

Plastic container that is to be filled with a hot product includes a threaded neck portion, a base portion including a standing surface and a moveable element, and a body portion including a dome portion, first and second label stop portions, a supplemental vacuum panel and a sidewall relatively free of structural geometry that surrounds an interior of the body portion. During cooling, the hot product is contracted so as to create an induced vacuum. The supplemental vacuum panel is configured and operative to remove a first portion of an induced vacuum, and the moveable element is configured and operative to move from a first position to a second position to remove a second portion of the vacuum, wherein the first portion of the vacuum and the second portion of the vacuum constitute substantially the entire vacuum.

14 Claims, 14 Drawing Sheets

Related U.S. Application Data continuation of application No. 10/566,294, filed as application No. PCT/US2004/024581 on Jul. 30, 2004, now Pat. No. 7,726,106.

(60) Provisional application No. 60/551,771, filed on Mar. 11, 2004, provisional application No. 60/491,179, filed on Jul. 30, 2003.

(51) Int. Cl.

| | |
|---|---|
| ***B65B 21/12*** | (2006.01) |
| ***B65B 61/24*** | (2006.01) |
| ***B65B 63/08*** | (2006.01) |
| ***B67C 3/04*** | (2006.01) |
| ***B67C 3/14*** | (2006.01) |
| ***B67C 3/24*** | (2006.01) |
| ***B67C 7/00*** | (2006.01) |
| ***B65B 9/04*** | (2006.01) |
| *B67C 3/22* | (2006.01) |

(52) U.S. Cl.

CPC ..... *B65B 63/08* (2013.01); *B65D 1/0261* (2013.01); *B65D 1/40* (2013.01); *B67C 3/045* (2013.01); *B67C 3/14* (2013.01); *B67C 3/242* (2013.01); *B67C 7/00* (2013.01); *B67C 7/0026* (2013.01); *B67C 7/0053* (2013.01); *B67C 2003/226* (2013.01)

(58) Field of Classification Search

USPC ..... 220/609, 624, 669, 675; 215/381

See application file for complete search history.

(56) References Cited

U.S. PATENT DOCUMENTS

D110,624 S 7/1938 Mekeel, Jr.
2,124,959 A 7/1938 Vogel
2,378,324 A 6/1945 Ray et al.
2,880,902 A 4/1959 Owsen
2,960,248 A 11/1960 Kuhlman
2,971,671 A 2/1961 Shakman
2,982,440 A 5/1961 Harrison
3,043,461 A 7/1962 Glassco
3,081,002 A 3/1963 Tauschinski et al.
3,090,478 A 5/1963 Stanley
3,142,371 A 7/1964 Rice et al.
3,174,655 A 3/1965 Hurschman
3,198,861 A 8/1965 Marvel
3,201,111 A 8/1965 Afton
3,301,293 A 1/1967 Santelli
3,325,031 A 6/1967 Singier
3,397,724 A 8/1968 Bolen et al.
3,409,167 A 11/1968 Blanchard
3,417,893 A 12/1968 Lieberman
3,426,939 A * 2/1969 Young ..... B65D 1/40 220/609
3,441,982 A 5/1969 Tsukahara et al.
3,468,443 A 9/1969 Marcus
3,483,908 A 12/1969 Donovan
3,485,355 A 12/1969 Stewart
3,693,828 A 9/1972 Kneusel et al.
3,704,140 A 11/1972 Petit et al.
3,727,783 A 4/1973 Carmichael
3,791,508 A 2/1974 Osborne et al.
3,819,789 A 6/1974 Parker
3,904,069 A 9/1975 Toukmanian
3,918,920 A 11/1975 Barber
3,935,955 A 2/1976 Das
3,941,237 A 3/1976 MacGregor
3,942,673 A 3/1976 Lyu et al.
3,949,033 A 4/1976 Uhlig
3,956,441 A 5/1976 Uhlig
4,035,455 A 7/1977 Rosenkranz et al.
4,036,926 A 7/1977 Chang
4,037,752 A 7/1977 Dulmaine et al.
4,117,062 A 9/1978 Uhlig
4,123,217 A 10/1978 Fischer et al.
4,125,632 A 11/1978 Vosti et al.
4,134,510 A 1/1979 Chang
4,158,624 A 6/1979 Ford et al.
4,170,622 A 10/1979 Uhlig
4,174,782 A 11/1979 Obsomer
4,177,239 A 12/1979 Gittner et al.
4,219,137 A 8/1980 Hutchens
4,231,483 A 11/1980 Dechenne et al.
4,247,012 A 1/1981 Alberghini
4,301,933 A 11/1981 Yoshino et al.
4,318,489 A 3/1982 Snyder et al.
4,318,882 A 3/1982 Agrawal et al.
4,338,765 A 7/1982 Ohmori et al.
4,355,728 A 10/1982 Ota et al.
4,377,191 A 3/1983 Yamaguchi
4,378,328 A 3/1983 Przytulla et al.
4,381,061 A 4/1983 Cerny et al.
D269,158 S 5/1983 Gaunt et al.
4,386,701 A 6/1983 Galer
4,436,216 A 3/1984 Chang
4,444,308 A 4/1984 MacEwen
4,450,878 A 5/1984 Takada et al.
4,465,199 A 8/1984 Aoki
4,495,974 A 1/1985 Pohorski
4,497,621 A 2/1985 Kkudert et al.
4,497,855 A 2/1985 Agrawal et al.
4,525,401 A 6/1985 Pocock et al.
4,542,029 A 9/1985 Caner et al.
4,547,333 A 10/1985 Takada
4,585,158 A 4/1986 Wardlaw, III
4,610,366 A 9/1986 Estes et al.
4,628,669 A 12/1986 Herron et al.
4,642,968 A 2/1987 McHenry et al.
4,645,078 A 2/1987 Reyner
4,658,974 A 4/1987 Fujita et al.
4,667,454 A 5/1987 McHenry et al.
4,684,025 A 8/1987 Copland et al.
4,685,273 A 8/1987 Caner et al.
D292,378 S 10/1987 Brandt et al.
4,701,121 A 10/1987 Jakobsen et al.
4,723,661 A 2/1988 Hoppmann et al.
4,724,855 A 2/1988 Jackson et al.
4,725,464 A 2/1988 Collette
4,747,507 A 5/1988 Fitzgerald et al.
4,749,092 A 6/1988 Sugiura et al.
4,769,206 A 9/1988 Reymann et al.
4,773,458 A 9/1988 Touzani
4,785,949 A 11/1988 Krishnakumar et al.
4,785,950 A 11/1988 Miller et al.
4,807,424 A 2/1989 Robinson et al.
4,813,556 A 3/1989 Lawrence
4,831,050 A 5/1989 Cassidy et al.
4,836,398 A 6/1989 Leftault, Jr. et al.
4,840,289 A 6/1989 Fait et al.
4,850,493 A 7/1989 Howard, Jr.
4,850,494 A 7/1989 Howard, Jr.
4,865,206 A 9/1989 Behm et al.
4,867,323 A 9/1989 Powers
4,880,129 A 11/1989 McHenry et al.
4,887,730 A 12/1989 Touzani
4,892,205 A 1/1990 Powers et al.
4,896,205 A 1/1990 Weber
4,919,284 A 4/1990 Tiedemann et al.
4,921,147 A 5/1990 Poirier
4,927,679 A 5/1990 Beck
4,946,053 A * 8/1990 Conrad ..... B65D 1/0223 215/381
4,962,863 A 10/1990 Wendling et al.
4,967,538 A 11/1990 Leftault, Jr. et al.
4,978,015 A 12/1990 Walker
4,997,692 A 3/1991 Yoshino
5,004,109 A 4/1991 Bartley et al.
5,005,716 A 4/1991 Eberle
5,014,868 A 5/1991 Wittig et al.
5,020,691 A 6/1991 Nye

(56) References Cited

U.S. PATENT DOCUMENTS 5,024,340 A 6/1991 Alberghini et al.
5,033,254 A 7/1991 Zenger
5,054,632 A 10/1991 Alberghini et al.
5,060,453 A 10/1991 Alberghini et al.
5,067,622 A 11/1991 Garver et al.
5,090,180 A 2/1992 Sorensen
5,092,474 A 3/1992 Leigner
5,122,327 A 6/1992 Spina et al.
5,133,468 A 7/1992 Brunson et al.
5,141,121 A 8/1992 Brown et al.
5,178,290 A 1/1993 Ota et al.
5,199,587 A 4/1993 Ota et al.
5,199,588 A 4/1993 Hayashi
5,201,438 A 4/1993 Norwood
5,217,737 A 6/1993 Gygax et al.
5,234,126 A 8/1993 Jonas et al.
5,244,106 A 9/1993 Takacs
5,251,424 A 10/1993 Zenger et al.
5,255,889 A 10/1993 Collette et al.
5,261,544 A 11/1993 Weaver, Jr.
5,279,433 A 1/1994 Krishnakumar et al.
5,281,387 A 1/1994 Collette et al.
5,310,043 A 5/1994 Alcorn
5,333,761 A 8/1994 Davis et al.
5,337,909 A 8/1994 Vailliencourt
5,337,924 A 8/1994 Dickie
5,341,946 A 8/1994 Valliencourt et al.
5,389,332 A 2/1995 Amari et al.
5,392,937 A 2/1995 Prevot et al.
5,405,015 A 4/1995 Bhatia et al.
5,407,086 A 4/1995 Ota et al.
5,411,699 A 5/1995 Collette et al.
5,454,481 A 10/1995 Hsu
5,472,105 A 12/1995 Krishnakumar et al.
5,472,181 A 12/1995 Lowell
RE35,140 E 1/1996 Powers, Jr.
5,484,052 A 1/1996 Pawloski et al.
D366,831 S 2/1996 Semersky et al.
5,492,245 A 2/1996 Kalbanis
5,503,283 A 4/1996 Semersky
5,543,107 A 8/1996 Malik et al.
5,574,846 A 11/1996 Yoshimura et al.
5,593,063 A 1/1997 Claydon et al.
5,598,941 A 2/1997 Semersky et al.
5,632,397 A 5/1997 Fandeux et al.
5,642,826 A 7/1997 Melrose
5,672,730 A 9/1997 Cottman
5,687,874 A 11/1997 Omori et al.
5,690,244 A 11/1997 Darr
5,697,489 A 12/1997 Deonarine et al.
5,704,504 A 1/1998 Bueno
5,713,480 A 2/1998 Petre et al.
5,718,030 A 2/1998 Langmack et al.
5,730,314 A 3/1998 Wiemann et al.
5,730,914 A 3/1998 Ruppman, Sr.
5,735,420 A 4/1998 Nakamaki et al.
5,737,827 A 4/1998 Kuse et al.
5,758,802 A 6/1998 Wallays
5,762,221 A 6/1998 Tobias et al.
5,780,130 A 7/1998 Hansen et al.
5,785,197 A 7/1998 Slat
5,819,507 A 10/1998 Kaneko et al.
5,829,614 A 11/1998 Collette et al.
5,858,300 A 1/1999 Shimizu et al.
5,860,556 A 1/1999 Robbins, III
5,887,739 A 3/1999 Prevot et al.
5,888,598 A 3/1999 Brewster et al.
5,897,090 A 4/1999 Smith et al.
5,906,286 A 5/1999 Matsuno et al.
5,908,128 A 6/1999 Krishnakumar et al.
D413,519 S 9/1999 Eberle et al.
D415,030 S 10/1999 Searle et al.
5,971,184 A 10/1999 Krishnakumar et al.
5,976,653 A 11/1999 Collette et al.
5,989,661 A 11/1999 Krishnakumar et al.
6,016,932 A 1/2000 Gaydosh et al.
RE36,639 E 4/2000 Okhai
6,044,996 A * 4/2000 Carew ..... B65D 79/005 215/381
6,045,001 A 4/2000 Seul
6,051,295 A 4/2000 Schloss et al.
6,063,325 A 5/2000 Nahill et al.
6,065,624 A 5/2000 Steinke
6,068,110 A 5/2000 Kumakiri et al.
6,074,596 A 6/2000 Jacquet
6,077,554 A 6/2000 Wiemann et al.
6,090,334 A 7/2000 Matsuno et al.
6,105,815 A 8/2000 Mazda
6,113,377 A 9/2000 Clark
D433,946 S 11/2000 Rollend et al.
6,176,382 B1 1/2001 Bazlur
D440,877 S 4/2001 Lichtman et al.
6,209,710 B1 4/2001 Mueller et al.
6,213,325 B1 4/2001 Cheng et al.
6,213,326 B1 * 4/2001 Denner ..... B65D 1/0223 215/383
6,217,818 B1 4/2001 Collette et al.
6,228,317 B1 5/2001 Smith et al.
6,230,912 B1 5/2001 Rashid
6,248,413 B1 6/2001 Barel et al.
6,253,809 B1 7/2001 Paradies
6,273,282 B1 8/2001 Ogg et al.
6,277,321 B1 8/2001 Vailliencourt et al.
6,298,638 B1 10/2001 Bettle
D450,595 S 11/2001 Ogg et al.
6,354,427 B1 3/2002 Pickel et al.
6,375,025 B1 4/2002 Mooney
6,390,316 B1 5/2002 Mooney
6,413,466 B1 7/2002 Boyd et al.
6,439,413 B1 * 8/2002 Prevot ..... B65D 1/0223 215/381
6,460,714 B1 10/2002 Silvers et al.
6,467,639 B2 10/2002 Mooney
6,485,669 B1 11/2002 Boyd et al.
6,494,333 B2 12/2002 Sasaki et al.
6,502,369 B1 1/2003 Andison et al.
6,514,451 B1 2/2003 Boyd et al.
6,585,123 B1 7/2003 Pedmo et al.
6,585,124 B2 7/2003 Boyd et al.
6,595,380 B2 7/2003 Silvers
6,612,451 B2 9/2003 Tobias et al.
6,635,217 B1 10/2003 Britton
D482,976 S 12/2003 Melrose
6,662,960 B2 12/2003 Hong et al.
6,676,883 B2 1/2004 Hutchinson et al.
D492,201 S 6/2004 Pritchett et al.
6,749,075 B2 6/2004 Bourque et al.
6,749,780 B2 6/2004 Tobias
6,763,968 B1 7/2004 Boyd et al.
6,763,969 B1 7/2004 Melrose et al.
6,769,561 B2 8/2004 Futral et al.
6,779,673 B2 8/2004 Melrose et al.
6,796,450 B2 9/2004 Prevot et al.
6,857,531 B2 * 2/2005 Slat ..... B65D 1/0276 215/373
6,920,992 B2 7/2005 Lane et al.
6,923,334 B2 8/2005 Melrose et al.
6,929,138 B2 8/2005 Melrose et al.
6,932,230 B2 8/2005 Pedmo et al.
6,942,116 B2 9/2005 Lisch et al.
6,974,047 B2 12/2005 Kelley et al.
6,983,858 B2 1/2006 Slat et al.
7,051,073 B1 5/2006 Dutta
7,051,889 B2 5/2006 Boukobza
D522,368 S 6/2006 Darr et al.
7,073,675 B2 7/2006 Trude
7,077,279 B2 7/2006 Melrose
7,080,747 B2 7/2006 Lane et al.
D531,910 S 11/2006 Melrose
7,137,520 B1 11/2006 Melrose
7,140,505 B2 11/2006 Roubal et al.
7,150,372 B2 12/2006 Lisch et al.
D535,884 S 1/2007 Davis et al.
7,159,374 B2 1/2007 Abercrombie, III et al.

(56) References Cited

U.S. PATENT DOCUMENTS

| | | | |
|---|---|---|---|
| D538,168 | S | 3/2007 | Davis et al. |
| D547,664 | S | 7/2007 | Davis et al. |
| 7,334,695 | B2 | 2/2008 | Bysick et al. |
| 7,350,657 | B2 | 4/2008 | Eaton et al. |
| D572,599 | S | 7/2008 | Melrose |
| 7,416,089 | B2 | 8/2008 | Kraft et al. |
| D576,041 | S | 9/2008 | Melrose et al. |
| 7,451,886 | B2 | 11/2008 | Lisch et al. |
| 7,543,713 | B2 | 6/2009 | Trude et al. |
| 7,552,834 | B2 | 6/2009 | Tanaka et al. |
| 7,574,846 | B2 | 8/2009 | Sheets et al. |
| 7,694,842 | B2 | 4/2010 | Melrose |
| 7,726,106 | B2 | 6/2010 | Kelley et al. |
| 7,735,304 | B2 | 6/2010 | Kelley et al. |
| 7,748,551 | B2 | 7/2010 | Gatewood et al. |
| D623,952 | S | 9/2010 | Yourist et al. |
| 7,799,264 | B2 | 9/2010 | Trude |
| 7,882,971 | B2 | 2/2011 | Kelley et al. |
| 7,900,425 | B2 | 3/2011 | Bysick et al. |
| 7,926,243 | B2 | 4/2011 | Kelley et al. |
| D637,495 | S | 5/2011 | Gill et al. |
| D637,913 | S | 5/2011 | Schlies et al. |
| D641,244 | S | 7/2011 | Bysick et al. |
| 7,980,404 | B2 | 7/2011 | Trude et al. |
| 8,011,166 | B2 | 9/2011 | Sheets et al. |
| 8,017,065 | B2 | 9/2011 | Trude et al. |
| D646,966 | S | 10/2011 | Gill et al. |
| 8,028,498 | B2 | 10/2011 | Melrose |
| 8,075,833 | B2 | 12/2011 | Kelley |
| D653,119 | S | 1/2012 | Hunter et al. |
| 8,096,098 | B2 | 1/2012 | Kelley et al. |
| D653,550 | S | 2/2012 | Hunter et al. |
| D653,957 | S | 2/2012 | Yourist et al. |
| 8,162,655 | B2 | 4/2012 | Trude et al. |
| 8,171,701 | B2 | 5/2012 | Kelley et al. |
| 8,235,704 | B2 | 8/2012 | Kelley |
| 8,323,555 | B2 | 12/2012 | Trude et al. |
| 8,539,743 | B2 | 9/2013 | Rapparini |
| 2001/0035391 | A1 | 11/2001 | Young et al. |
| 2002/0063105 | A1 | 5/2002 | Darr et al. |
| 2002/0074336 | A1 | 6/2002 | Silvers |
| 2002/0096486 | A1 | 7/2002 | Bourque et al. |
| 2002/0153343 | A1 | 10/2002 | Tobias et al. |
| 2002/0158038 | A1* | 10/2002 | Heisel ..... B65D 1/40 215/382 |
| 2003/0015491 | A1 | 1/2003 | Melrose et al. |
| 2003/0186006 | A1 | 10/2003 | Schmidt et al. |
| 2003/0196926 | A1 | 10/2003 | Tobias et al. |
| 2003/0205550 | A1 | 11/2003 | Prevot et al. |
| 2003/0217947 | A1 | 11/2003 | Ishikawa et al. |
| 2004/0000533 | A1 | 1/2004 | Kamineni et al. |
| 2004/0016716 | A1 | 1/2004 | Melrose et al. |
| 2004/0074864 | A1 | 4/2004 | Melrose et al. |
| 2004/0129669 | A1 | 7/2004 | Kelley et al. |
| 2004/0149677 | A1 | 8/2004 | Slat et al. |
| 2004/0173565 | A1 | 9/2004 | Semersky et al. |
| 2004/0211746 | A1 | 10/2004 | Trude |
| 2004/0232103 | A1 | 11/2004 | Lisch et al. |
| 2005/0035083 | A1 | 2/2005 | Pedmo et al. |
| 2005/0211662 | A1 | 9/2005 | Eaton et al. |
| 2005/0218108 | A1 | 10/2005 | Bangi et al. |
| 2006/0006133 | A1 | 1/2006 | Lisch et al. |
| 2006/0051541 | A1 | 3/2006 | Steele |
| 2006/0138074 | A1 | 6/2006 | Melrose |
| 2006/0151425 | A1 | 7/2006 | Kelley et al. |
| 2006/0231985 | A1 | 10/2006 | Kelley |
| 2006/0243698 | A1 | 11/2006 | Melrose |
| 2006/0255005 | A1 | 11/2006 | Melrose et al. |
| 2006/0261031 | A1 | 11/2006 | Melrose |
| 2007/0017892 | A1 | 1/2007 | Melrose |
| 2007/0045222 | A1 | 3/2007 | Denner et al. |
| 2007/0045312 | A1 | 3/2007 | Abercrombie, III et al. |
| 2007/0051073 | A1 | 3/2007 | Kelley et al. |
| 2007/0084821 | A1 | 4/2007 | Bysick et al. |
| 2007/0125742 | A1 | 6/2007 | Simpson, Jr. et al. |
| 2007/0125743 | A1 | 6/2007 | Pritchett, Jr. et al. |
| 2007/0131644 | A1 | 6/2007 | Melrose |
| 2007/0181403 | A1 | 8/2007 | Sheets et al. |
| 2007/0199915 | A1 | 8/2007 | Denner et al. |
| 2007/0199916 | A1 | 8/2007 | Denner et al. |
| 2007/0215571 | A1 | 9/2007 | Trude |
| 2007/0235905 | A1 | 10/2007 | Trude et al. |
| 2008/0047964 | A1 | 2/2008 | Denner et al. |
| 2008/0156847 | A1 | 7/2008 | Hawk et al. |
| 2008/0257856 | A1 | 10/2008 | Melrose et al. |
| 2009/0090728 | A1 | 4/2009 | Trude et al. |
| 2009/0091067 | A1 | 4/2009 | Trude et al. |
| 2009/0092720 | A1 | 4/2009 | Trude et al. |
| 2009/0120530 | A1 | 5/2009 | Kelley et al. |
| 2009/0134117 | A1 | 5/2009 | Mooney |
| 2009/0202766 | A1 | 8/2009 | Beuerle et al. |
| 2009/0293436 | A1 | 12/2009 | Miyazaki et al. |
| 2010/0018838 | A1 | 1/2010 | Kelley et al. |
| 2010/0116778 | A1 | 5/2010 | Melrose |
| 2010/0133228 | A1 | 6/2010 | Trude |
| 2010/0163513 | A1 | 7/2010 | Pedmo |
| 2010/0170199 | A1 | 7/2010 | Kelley et al. |
| 2010/0213204 | A1 | 8/2010 | Melrose |
| 2010/0237083 | A1 | 9/2010 | Trude et al. |
| 2010/0301058 | A1 | 12/2010 | Trude et al. |
| 2011/0049083 | A1 | 3/2011 | Scott et al. |
| 2011/0049084 | A1 | 3/2011 | Yourist et al. |
| 2011/0084046 | A1 | 4/2011 | Schlies et al. |
| 2011/0094618 | A1 | 4/2011 | Melrose |
| 2011/0108515 | A1 | 5/2011 | Gill et al. |
| 2011/0113731 | A1 | 5/2011 | Bysick et al. |
| 2011/0132865 | A1 | 6/2011 | Hunter et al. |
| 2011/0147392 | A1 | 6/2011 | Trude et al. |
| 2011/0210133 | A1 | 9/2011 | Melrose et al. |
| 2011/0266293 | A1 | 11/2011 | Kelley et al. |
| 2011/0284493 | A1 | 11/2011 | Yourist et al. |
| 2012/0104010 | A1 | 5/2012 | Kelley |
| 2012/0107541 | A1 | 5/2012 | Nahill et al. |
| 2012/0132611 | A1 | 5/2012 | Trude et al. |
| 2012/0152964 | A1 | 6/2012 | Kelley et al. |
| 2012/0240515 | A1 | 9/2012 | Kelley et al. |
| 2012/0266565 | A1 | 10/2012 | Trude et al. |
| 2012/0267381 | A1 | 10/2012 | Trude et al. |
| 2013/0000259 | A1 | 1/2013 | Trude et al. |

FOREIGN PATENT DOCUMENTS

| | | | |
|---|---|---|---|
| DE | 1761753 | | 1/1972 |
| DE | P2102319.8 | | 8/1972 |
| DE | 3215866 | A1 | 11/1983 |
| EP | 0 225 155 | A2 | 6/1987 |
| EP | 0 346 518 | A1 | 12/1989 |
| EP | 0 502 391 | A2 | 9/1992 |
| EP | 0 505 054 | A1 | 9/1992 |
| EP | 0 521 642 | A1 | 1/1993 |
| EP | 0 551 788 | A1 | 7/1993 |
| EP | 0 666 222 | A1 | 8/1995 |
| EP | 0 739 703 | B1 | 10/1996 |
| EP | 0 609 348 | B1 | 2/1997 |
| EP | 0 916 406 | A2 | 5/1999 |
| EP | 0 957 030 | A2 | 11/1999 |
| EP | 1 063 076 | A1 | 12/2000 |
| FR | 1571499 | | 6/1969 |
| FR | 2607109 | A1 | 5/1988 |
| GB | 781103 | | 8/1957 |
| GB | 1113988 | | 5/1968 |
| GB | 2050919 | A | 1/1981 |
| GB | 2372977 | A | 9/2002 |
| JP | S40-15909 | | 6/1940 |
| JP | 48-31050 | | 9/1973 |
| JP | 49-28628 | | 7/1974 |
| JP | 54-72181 | A | 6/1979 |
| JP | S54-70185 | A | 6/1979 |
| JP | 35656830 | A | 5/1981 |
| JP | S56-62911 | U | 5/1981 |
| JP | 56-72730 | U | 6/1981 |
| JP | S57-17730 | | 1/1982 |
| JP | 57-37827 | U | 2/1982 |
| JP | 57-126310 | U | 8/1982 |

(56) References Cited

FOREIGN PATENT DOCUMENTS

| | | | |
|---|---|---|---|
| JP | 357-210829 | A | 12/1982 |
| JP | 58-055005 | U | 4/1983 |
| JP | 61-192539 | A | 8/1986 |
| JP | 63-189224 | A | 8/1988 |
| JP | 64-004662 | | 2/1989 |
| JP | 3-43342 | A | 2/1991 |
| JP | 03-076625 | A | 4/1991 |
| JP | 4-10012 | | 1/1992 |
| JP | 5-193694 | | 8/1993 |
| JP | 53-10239 | | 11/1993 |
| JP | H05-81009 | | 11/1993 |
| JP | H06-270235 | A | 9/1994 |
| JP | 6-336238 | A | 12/1994 |
| JP | 07-300121 | A | 11/1995 |
| JP | H08-048322 | A | 2/1996 |
| JP | H08-244747 | A | 9/1996 |
| JP | 8-253220 | A | 10/1996 |
| JP | 8-282633 | A | 10/1996 |
| JP | 09-039934 | A | 2/1997 |
| JP | 9-110045 | A | 4/1997 |
| JP | 10-230919 | A | 2/1998 |
| JP | H10-167226 | A | 6/1998 |
| JP | 10181734 | A | 7/1998 |
| JP | 3056271 | | 11/1998 |
| JP | H11-218537 | A | 8/1999 |
| JP | 2000-229615 | A | 8/2000 |
| JP | 2002-127237 | A | 5/2002 |
| JP | 2002-160717 | A | 6/2002 |
| JP | 2002-326618 | A | 11/2002 |
| JP | 2003-095238 | A | 4/2003 |
| JP | 2004-026307 | A | 1/2004 |
| JP | 2006-501109 | A | 1/2006 |
| JP | 2007-216981 | A | 8/2007 |
| JP | 2008-189721 | A | 8/2008 |
| JP | 2009-001639 | A | 1/2009 |
| NZ | 240448 | A | 6/1995 |
| NZ | 296014 | A | 10/1998 |
| NZ | 335565 | A | 10/1999 |
| NZ | 506684 | | 9/2001 |
| NZ | 512423 | | 9/2001 |
| NZ | 521694 | | 10/2003 |
| WO | WO 93/09031 | A1 | 5/1993 |
| WO | WO 93/12975 | A1 | 7/1993 |
| WO | WO 94/05555 | A1 | 3/1994 |
| WO | WO 94/06617 | A1 | 3/1994 |
| WO | WO 97/03885 | A1 | 2/1997 |
| WO | WO 97/14617 | A1 | 4/1997 |
| WO | WO 97/34808 | A1 | 9/1997 |
| WO | WO 99/21770 | A1 | 5/1999 |
| WO | WO 00/38902 | A1 | 7/2000 |
| WO | WO 00/51895 | A1 | 9/2000 |
| WO | WO 01/12531 | A1 | 2/2001 |
| WO | WO 01/40081 | A1 | 6/2001 |
| WO | WO 2001/074689 | A1 | 10/2001 |
| WO | WO 02/02418 | A1 | 1/2002 |
| WO | WO 02/18213 | A1 | 3/2002 |
| WO | WO 02/085755 | A1 | 10/2002 |
| WO | WO 2004/028910 | A1 | 4/2004 |
| WO | WO 2004/106176 | A2 | 9/2004 |
| WO | WO 2004/106175 | A1 | 12/2004 |
| WO | WO 2005/012091 | A2 | 2/2005 |
| WO | WO 2005/025999 | A1 | 3/2005 |
| WO | WO 2005/087628 | A1 | 9/2005 |
| WO | WO 2006/113428 | A3 | 10/2006 |
| WO | WO 2007/047574 | A1 | 4/2007 |
| WO | WO 2007/127337 | A2 | 11/2007 |
| WO | WO 2010/058098 | A2 | 5/2010 |

OTHER PUBLICATIONS

U.S. Appl. No. 13/210,358, filed Aug. 15, 2011, Wurster, et al.
U.S. Appl. No. 13/251,966, filed Oct. 3, 2011, Howell, et al.
U.S. Appl. No. 13/410,902, filed Mar. 2, 2012, Gill.
U.S. Appl. No. 10/566,294 (U.S. Pat. No. 7,726,106), filed Sep. 5, 2006 (Jun. 1, 2010).
U.S. Appl. No. 12/354,327 (U.S. Pat. No. 9,090,363), filed Jan. 15, 2009 (Jul. 28, 2015).
U.S. Appl. No. 12/325,452 (U.S. Pat. No. 7,735,304), filed Dec. 1, 2008 (Jun. 15, 2010).
U.S. Appl. No. 13/407,131 (U.S. Pat. No. 8,671,653), filed Feb. 28, 2012 (Mar. 18, 2014).
U.S. Appl. No. 13/407,131, Jan. 27, 2014 Issue Fee Payment.
U.S. Appl. No. 13/407,131, Dec. 23, 2013 Notice of Allowance.
U.S. Appl. No. 13/407,131, Nov. 4, 2013 Amendment and Request for Continued Examination (RCE).
U.S. Appl. No. 13/407,131, Oct. 2, 2013 Response after Final Action.
U.S. Appl. No. 13/407,131, Aug. 2, 2013 Final Office Action.
U.S. Appl. No. 13/407,131, Jul. 24, 2013 Response to Non-Final Office Action.
U.S. Appl. No. 13/407,131, Apr. 24, 2013 Non-Final Office Action.
U.S. Appl. No. 13/407,131, Apr. 12, 2013 Response to Restriction Requirement.
U.S. Appl. No. 13/407,131, Mar. 12, 2013 Response to Restriction Requirement.
U.S. Appl. No. 13/407,131, Feb. 12, 2013 Restriction Requirement Filed.
U.S. Appl. No. 12/354,327, Jun. 19, 2015 Issue Fee Payment.
U.S. Appl. No. 12/354,327, Mar. 19, 2015 Notice of Allowance.
U.S. Appl. No. 12/354,327, Feb. 26, 2015 Response to Non-Final Office Action.
U.S. Appl. No. 12/354,327, Feb. 23, 2015 Applicant Initiated Interview Summary.
U.S. Appl. No. 12/354,327, Nov. 26, 2014 Non-Final Office Action.
U.S. Appl. No. 12/354,327, Oct. 8, 2014 Notice of Appeal Filed.
U.S. Appl. No. 12/354,327, Jul. 11, 2014 Final Office Action.
U.S. Appl. No. 12/354,327, Jun. 25, 2014 Response to Non-Final Office Action.
U.S. Appl. No. 12/354,327, Feb. 25, 2014 Non-Final Office Action.
U.S. Appl. No. 12/354,327, Jan. 21, 2014 Amendment and Request for Continued Examination (RCE).
U.S. Appl. No. 12/354,327, Nov. 13, 2013 Final Office Action.
U.S. Appl. No. 12/354,327, Oct. 29, 2013 Response to Non-Final Office Action.
U.S. Appl. No. 12/354,327, Oct. 22, 2013 Applicant Initiated Interview Summary.
U.S. Appl. No. 12/354,327, Jul. 29, 2013 Non-Final Office Action.
U.S. Appl. No. 12/354,327, Jul. 6, 2011 Amendment and Request for Continued Examination (RCE).
U.S. Appl. No. 12/354,327, May 5, 2011 Response after Final Action.
U.S. Appl. No. 12/354,327, Apr. 6, 2011 Final Office Action.
U.S. Appl. No. 12/354,327, Feb. 22, 2011 Response to Non-Final Office Action.
U.S. Appl. No. 12/354,327, Nov. 1, 2010 Non-Final Office Action.
U.S. Appl. No. 12/354,327, Sep. 23, 2010 Response to Restriction Requirement.
U.S. Appl. No. 12/354,327, Aug. 23, 2010 Restriction Requirement Filed.
U.S. Appl. No. 12/325,452, May 3, 2010 Issue Fee Payment.
U.S. Appl. No. 12/325,452, Feb. 2, 2010 Notice of Allowance.
U.S. Appl. No. 12/325,452, Dec. 7, 2009 Response to Restriction Requirement.
U.S. Appl. No. 12/325,452, Nov. 24, 2009 Restriction Requirement Filed.
U.S. Appl. No. 10/566,294, Apr. 12, 2010 Issue Fee Payment.
U.S. Appl. No. 10/566,294, Jan. 11, 2010 Notice of Allowance.
U.S. Appl. No. 10/566,294, Nov. 23, 2009 Amendment and Request for Continued Examination (RCE).
U.S. Appl. No. 10/566,294, Sep. 10, 2009 Final Office Action.
U.S. Appl. No. 10/566,294, Jun. 22, 2009 Response to Non-Final Office Action.
U.S. Appl. No. 10/566,294, Apr. 21, 2009 Non-Final Office Action.
U.S. Appl. No. 10/566,294, Mar. 18, 2009 Amendment and Request for Continued Examination (RCE).
U.S. Appl. No. 10/566,294, Feb. 13, 2009 Final Office Action.

(56) References Cited

OTHER PUBLICATIONS

U.S. Appl. No. 10/566,294, Dec. 12, 2008 Response to Non-Final Office Action.
U.S. Appl. No. 10/566,294, Oct. 27, 2008 Non-Final Office Action.
U.S. Appl. No. 10/566,294, Oct. 6, 2008 Response to Restriction Requirement.
U.S. Appl. No. 10/566,294, Sep. 5, 2008 Restriction Requirement Filed.
"Application and Development of PET Plastic Bottle," Publication of Tsinghad Tongfang Optical Disc Co. Ltd., Issue 4, 2000, p. 41. (No English language translation available).
Australian Office Action dated Mar. 3, 2011 in Application No. 2010246525.
Australian Office Action dated Nov. 8, 2011, in Application No. 2011205106.
Communication dated Jun. 16, 2006, for European Application No. 04779595.0.
Communication dated Mar. 9, 2010 for European Application No. 09 173 607.4 enclosing European search report and European search opinion dated Feb. 25, 2010.
Certified copy of U.S. Appl. No. 60/220,326, filed Jul. 24, 2000 dated Oct. 29, 2008.
European Search Report for EPA 10185697.9 dated Mar. 21, 2011.
Examination Report dated Jul. 25, 2012, in New Zealand Patent Application No. 593486.
Examination Report for counterpart New Zealand Application No. 545528 dated Sep. 20, 2007.
Examination Report for counterpart New Zealand Application No. 545528 dated Jul. 1, 2008.
Examination Report for counterpart New Zealand Application No. 569422 dated Sep. 29, 2009.
Examination Report for counterpart New Zealand Application No. 569422 dated Jul. 1, 2008.
Examination Report for New Zealand Application No. 550336 dated Mar. 26, 2009.
Examination Report for New Zealand Application No. 563134 dated Aug. 3, 2009.
Examiner Report dated Jul. 23, 2010, Australian Application No. 2004261654.
Examiner Report dated May 26, 2010, in Australian Application No. 2004261654.
Examiner's Report dated Feb. 15, 2011 in Australian Application No. AU200630483.
Examiner's Report dated Mar. 3, 2011 for application No. AU 2010246525.
Examiner's Report for Australian Application No. 2006236674 dated Sep. 18, 2009.
Examiner's Report for Australian Application No. 2006236674 dated Nov. 6, 2009.
Extended European Search Report for EPA 10185697.9 dated Jul. 6, 2011.
Final Office Action for U.S. Appl. No. 10/558,284 dated Sep. 9, 2008.
Final Office Action for U.S. Appl. No. 10/851,083 dated Jun. 12, 2008.
Final Office Action for U.S. Appl. No. 10/566,294 dated Feb. 13, 2009.
Final Office Action for U.S. Appl. No. 10/566,294 dated Sep. 10, 2009.
Final Official Notification dated Mar. 23, 2010 for Japanese Application No. 2006-522084.
International Preliminary Report on Patentability and Written Opinion dated Jun. 14, 2011 for PCT/US2009/066191. 7 pages.
International Search Report and Written Opinion dated Dec. 18, 2012, in PCT/US12/056330.
International Search Report and Written Opinion dated Mar. 15, 2010 for PCT/US2010/020045.
International Search Report and Written Opinion dated Sep. 8, 2009 for PCT/US2009/051023.
International Search Report and Written Opinion for PCT/US2012/050251 dated Nov. 16, 2012.
International Search Report and Written Opinion for PCT/US2012/050256 dated Dec. 6, 2012.
International Search report dated Apr. 21, 2010 from corresponding PCT/US2009/066191 filed Dec. 1, 2009.
International Search Report for PCT/US2004/016405 dated Feb. 15, 2005.
International Search Report for PCT/US2005/008374 dated Aug. 2, 2005.
International Search Report for PCT/US2006/014055 dated Dec. 7, 2006.
International Search Report for PCT/US2006/040361 dated Feb. 26, 2007.
International Search Report for PCT/US2007 /006318 dated Sep. 11, 2007.
IPRP (including Written Opinion) for PCT/US2005/008374 dated Sep. 13, 2006.
IPRP (includinQ Written Opinion) for PCT/US2004/016405 dated Nov. 25, 2005.
IPRP (including Written Opinion) for PCT/US2004/024581 dated Jan. 30, 2006.
IPRP (includinQ Written Opinion) for PCT/US2006/040361 dated Apr. 16, 2008.
IPRP (includinQ Written Opinion) PCT/US2006/014055 dated Oct. 16, 2007.
IPRP (includinQ Written Opinion) PCT/US2007/006318 dated Sep. 16, 2008.
ISR for PCT/US2004/024581 dated Jul. 25, 2005.
Japanese First Notice of Reasons for Rejection dated Aug. 23, 2011, in Application No. 2008-506738.
Japanese Second Notice of Reasons for Rejection dated Jun. 11, 2012, in Application No. 2008-506738.
Manas Chanda & Salil K. Roy, Plastics Technology Handbook, Fourth Edition, 2007 CRC Press, Taylor & Francis Group, pp. 2-34-2-37.
Office Action dated Aug. 14, 2012, in Japanese Patent Application No. 2008-535769.
Office Action dated Dec. 6, 2011, in Japanese Patent Application No. 2008-535769.
Office Action dated Feb. 3, 2010 for Canadian Application No. 2,604,231.
Office Action dated Feb. 5, 2013, in Mexican Patent Application No. MX/a/2008/004703.
Office Action dated Jul. 19, 2011, in Japanese Patent Application No. 2008-535769.
Office Action dated Jul. 26, 2010 for Canadian Application No. 2,527,001.
Office Action dated Nov. 24, 2009 for U.S. Appl. No. 12/325,452.
Office Action dated Oct. 31, 2011, in Australian Patent Application No. 2011203263.
Office Action dated Sep. 5, 2008 for U.S. Appl. No. 10/566,294.
Office Action for U.S. Appl. No. 10/851,083 dated Nov. 11, 2008.
Office Action for U.S. Appl. No. 10/558,284 dated Jan. 25, 2008.
Office Action for U.S. Appl. No. 10/566,294 dated Apr. 21, 2009.
Office Action for U.S. Appl. No. 10/566,294 dated Oct. 27, 2008.
Office Action for U.S. Appl. No. 10/851,083 dated Sep. 6, 2007.
Office Action for U.S. Appl. No. 11/249,342 dated Jun. 10, 2009.
Office Action for U.S. Appl. No. 11/375,040 dated Dec. 1, 2009.
Office Action for U.S. Appl. No. 11/399,430 dated Sep. 4, 2009.
Office Action for Application No. EP 06 750 165.0-2307 dated Nov. 24, 2008.
Office Action for Chinese Application No. 200680012360.7 dated Jul. 10, 2009.
Office Action for Chinese Application No. 2006800380748 dated Jul. 10, 2009.
Office Action for European Application No. 07752979.0-2307 dated Aug. 21, 2009.
Office Action, Japanese Application No. 2008-506738 dated Aug. 23, 2011.
Official Notification for counterpart Japanese Application No. 2006-522084 dated May 19, 2009.
Patent Abstracts of Japan, vol. 012, No. 464; Dec. 6, 1988.

(56) References Cited

OTHER PUBLICATIONS

Patent Abstracts of Japan, vol. 015, No. 239, Jun. 20, 1991.
Patent Abstracts of Japan, vol. 2002, No. 09, Sep. 4, 2002.
Requisition dated Feb. 3, 2010 for Canadian Application No. 2,604,231.
Requisition dated Jan. 9, 2013 for Canadian Application No. 2,559,319.
Requisition dated May 25, 2010 for Canadian Application No. 2,534,266.
Taiwanese Office Action dated Jun. 10, 2012, Application No. 095113450.

* cited by examiner

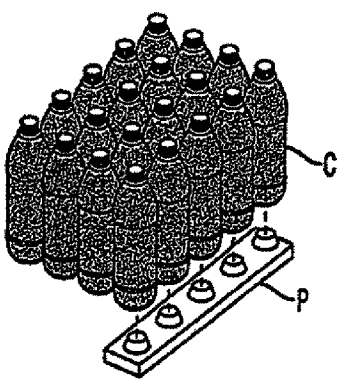
FIG. 5B
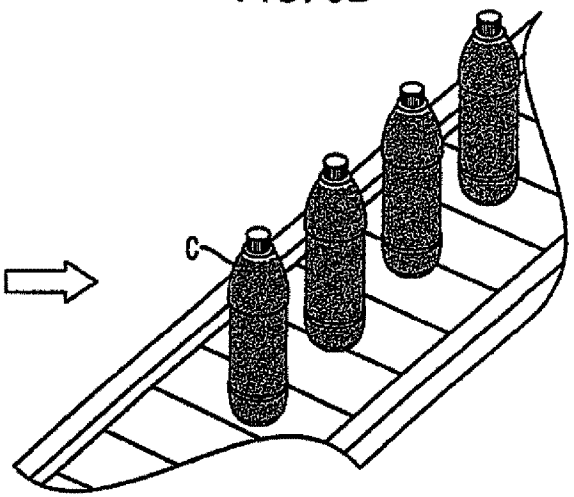
FIG. 5C
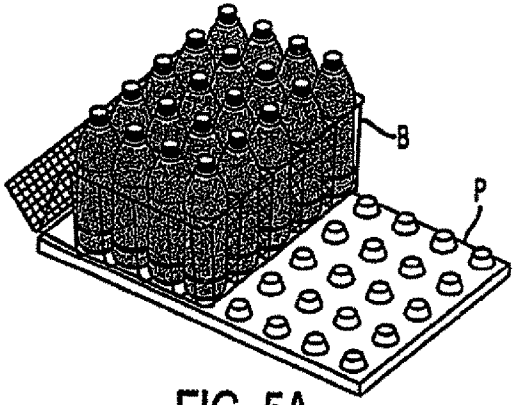
FIG. 5A
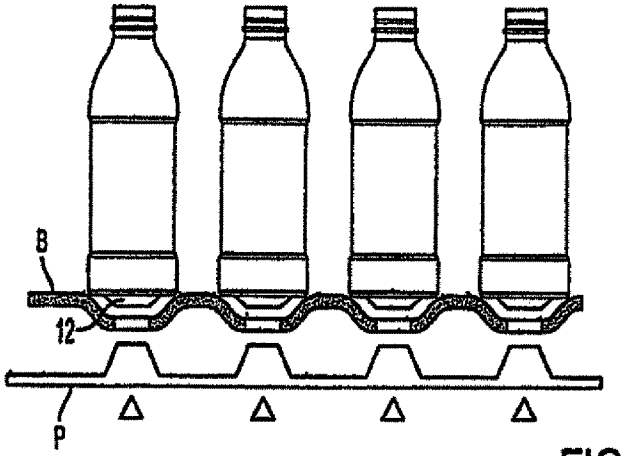

CONTAINER HANDLING SYSTEM

CROSS-REFERENCE TO RELATED APPLICATIONS

This application is a divisional of U.S. patent application Ser. No. 12/354,327 filed Jan. 15, 2009, which is a continuation of U.S. patent application Ser. No. 10/566,294, filed Sep. 5, 2006, which is a national stage entry of International Patent Application No. PCT/US2004/024581, filed Jul. 30, 2004, which claims priority to U.S. Provisional Application Ser. No. 60/551,771, filed Mar. 11, 2004, and 60/491,179, filed Jul. 30, 2003, each of which is incorporated by reference herein in its entirety.

BACKGROUND OF THE INVENTION

Field of the Invention

The present invention relates generally to a container handling system and a process for filling, capping and cooling hot-filled containers with a projection, and more particularly to a system and process for filling, capping and cooling hot-filled, blow-molded containers with a projection that can extend outside the container during the filling process and be inverted inside the container before the filled container is removed from a production line.

Related Art

Known blow-molded containers are usually made of plastic and employ flex panels that reinforce the integrity of the container while accommodating internal changes in pressures and volume in the container as a result of heating and cooling. This is especially true with hot-fillable containers, or containers in which hot products are injected during a filling process, capped and cooled to room temperature thereby allowing the filled product to cool to the ambient room temperature. Such containers are disclosed in U.S. Pat. Nos. 6,298,638, 6,439,413, and 6,467,639 assigned to Graham Packaging Company, all of which are incorporated by reference herein.

In order to obtain the necessary strength associated with glass containers, known hot-filled containers made out of plastic tend to be formed with protruding rib structures that surround panels forming the container. While the protruding rib structures improve the strength of the container that is blow-molded out of plastic, the resultant, lightweight, blow-molded containers with panels and protruding rib structure detract from the desired smooth, sleek look of a glass container. Accordingly, a hot-fillable, blow-molded container and process of filling, capping and cooling the same is needed that more closely simulates a glass container and achieves the smooth outward appearance associated with glass containers.

In addition to having protruding rib structures for strength, known hot-filled plastic containers tend to have rectangular panels for vacuum compensation. For example, conventional hot-fill containers, depending upon the size, may have 6 vacuum or flex panels to take up the resultant vacuum after cooling the hot-filled product with rigid, structural columns or ribs between each vacuum panel. It is known in the art to cover the protruding rib structures and panels with a paper label to improve the aesthetics or overall appearance of the plastic container. Consequently, in order to provide support for the label, the panels of such containers are provided with additional protruding structures. Thus, hot-filled containers are provided with more recesses and corners from which hot-filled solid products are not easily removed. Or, if the hot-filled product is subsequently chilled by placing the container in ice, the label covering the panels with protruding structures traps water inside the recessed panels resulting in spillage of the water after the container is removed from ice. Accordingly, a hot-filled, plastic container with a smoother side surface that is relatively or completely free of structural geometry is desired to overcome the shortcomings of the prior art.

BRIEF SUMMARY OF THE INVENTION

A three stage system utilizes a simplified, blow-molded container that retains its structural integrity after being hot filled and cooled through conventional food or beverage systems. That is, a simplified container according to the invention is a container with at least a portion of the container side walls being relatively smooth that can be filled with a hot product, such as a liquid or a partly solid product, and retain the requisite strength so that a number of containers can be stacked on top of one another with the resultant stack being sturdy. The relatively smooth surface is relatively or completely free of structural geometry, such as the structural ribs, riblets, or vacuum panels. In addition, the simplified, blow-molded container still retains the features of vacuum packaging and the ability to accommodate internal changes in pressure and volume as a result of heating and cooling. That is, the simplified container may employ a single main invertible projection by itself to take up the vacuum; or, the simplified container may have a few main projections that take up the vacuum while still providing a substantial portion of the container to be relatively smooth for label placement, for example. Alternatively, depending upon the size of the container, a mini vacuum panel to supplement the main invertible projection may be used to complete the removal of the resultant vacuum and finish the look of the cooled container. Unlike conventional containers, structural ribs between vacuum panels are not necessary in a simplified container where a substantial portion of the container body is relatively smooth.

Initially, a container is blow-molded with an approximately polygonal, circular or oval projection extending, for example, from a base of the container. The approximately polygonal, circular or oval projection may project from the shoulders of the container, or firm another area of the container. If the projection extends from the base of the container, before the container exits the blow-molding operation, the projection may be inverted inside the container so that the base surface of the blow-molded container is relatively flat so that the container can be easily conveyed on a table top, without toppling.

In the next stage, the blow-molded container may be picked-up by a robotic arm or the like and placed into a production line conveyor where it is supported by its neck. A mechanical operation causes a rod to be inserted in the neck of the container and pushes the inverted projection outside the container to provide for the increased volume necessary to receive a hot-filled product, as well as accommodating variations in pressure due to temperature changes during cooling. Alternatively, compressed air or other pressure may be used to push the inverted projection outside of the container. With the projection extending outside the container, the container is filled with a hot product, capped and moved to the cooling operation. Since the container is supported by its neck during the filling and capping operations, the process according to the invention provides maximum control of the containers while being filled and capped.

The third stage of the operation may divide the filled and capped containers into different lanes and then the containers may be positioned in a rack or basket before entering the cooler for the cooling of the hot-filled product. It is envisioned that a robotic arm may lift the filled and capped container with the projection extending from the container into a rack or basket. If the projection extends from the base of the container, the basket or rack is provided with an opening for receiving the projection and or enabling the container to stand upright. The container-filled basket or rack is then conveyed through a cooling system to bring the temperature of the hot-filled container to room temperature.

As the hot-filled product in the container is cooled to room temperature, the container becomes distorted as a vacuum is created in an area where the once hot product filled a portion of the container. Thus, there is no longer a need for the increased volume obtained by the projection extending from the container. In addition, the cooled, distorted container needs to be reformed to the aesthetic original container shape. Accordingly, it is now possible to return the containers to the desired aesthetic shape obtained after the cool-down contraction of the product by an activator that pushes against the extending projections while the containers are held in place thereby pushing the projection inside the container in an inverted state. This inverted state may be the same inverted state achieved before exiting the blow-molding operation.

The activator, according to one embodiment of the invention, may be a relatively flat piece of material with approximately polygonal or circular projections extending therefrom at intervals corresponding to openings of a basket that receive the container projections. The activator may be a panel that can invert projections of a single row of containers in the basket. Or, the activator may have several rows of polygonal or circular projections so that an entire basket of containers with projections can be inverted with one upward motion of the activator. While the preceding embodiment describes an activator for inverting projections extending from the base of a container, other activators for inverting projections extending from the shoulders or other areas of the container are envisioned. The activator panel can be made out of heavy plastic, metal or wood. The action of inverting the extending projection absorbs the space of the vacuum created by the cooling operation and provides all the vacuum compensation necessary for the cooled, product-filled container.

This invention satisfies a long felt need for a plastic, blow-molded container having a smooth outward appearance similar to that of a heavier glass container.

A system for manufacturing a simplified plastic container that is to be filled with a hot product, comprising the steps of blow-molding parison to form a container body, the container body having a neck, a base, a smooth side surface surrounding an interior of the container body and a projection extending from the container; filling the container body with the hot product in a production line; capping the neck of the filled container body with a cap in the next operation of the production line; cooling the container body filled with the hot product; and pushing the projection extending from the cooled container body into the interior of the container body so that the resultant, filled and cooled container body is relatively flat. If the projection extends from a base of the container, this inversion permits conveying of the container body on its base.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

FIGS. 5 A-C schematically illustrate one embodiment of an activation operation according to the invention;

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1B:
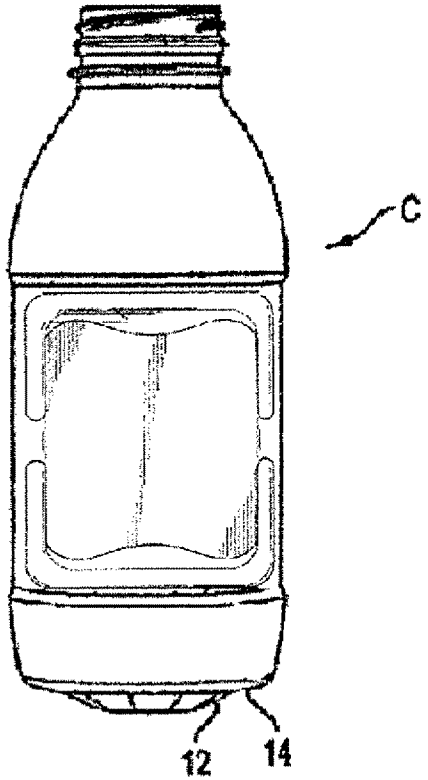
FIG. 1B illustrates an embodiment of a plastic, blow-molded container with a smooth surface according to the invention.
Figure 1A:
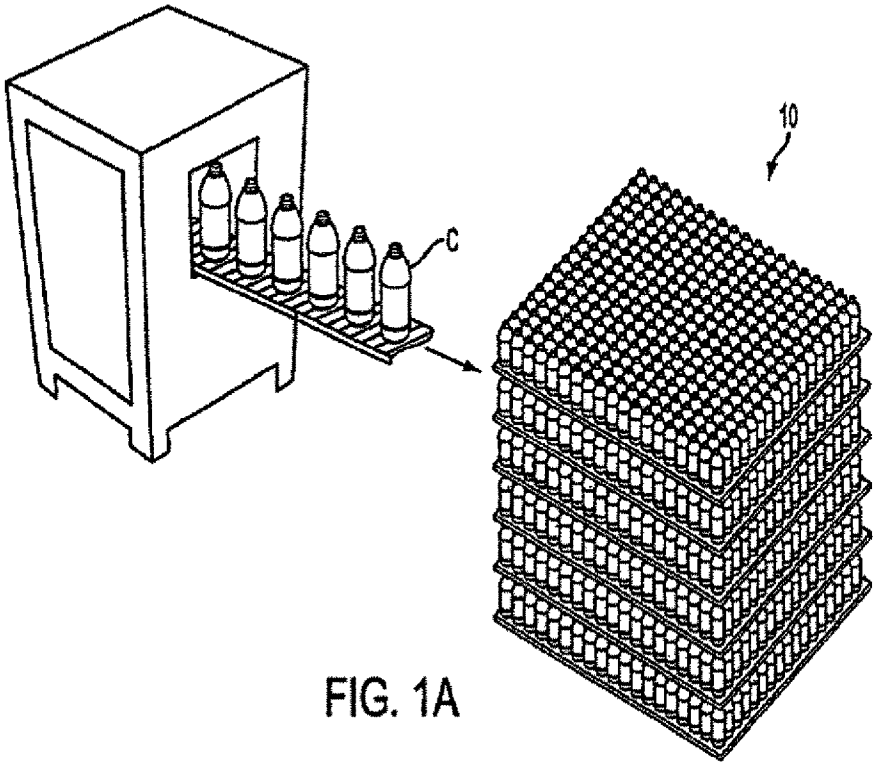
FIG. 1 A schematically depicts containers according to the invention leaving the blow-molding operation.

As shown schematically in FIG. 1A, containers C formed in a blow-molding or forming operation may exit the blow-molding operation with a base designed so that the container can stand on its own. That is, a container with a relatively smooth side surrounding its interior may be blow-molded with a projection extending from the base of the smooth sided container, and before the blow-molded container leaves the blow-molding operation, the projection of the base may be inverted inside the interior of the container so that the resultant base surface of the container can easily be conveyed in a table top manner. As shown in FIG. 1, the blow-molded containers may be placed in shipping containers 10 or on pallets with, for example, 24 columns and 20 rows so that each rack carries 480 bottles or containers. The inverted blow-molded projection can be designed so that the finish or neck area of a container can securely rest within the inverted blow-molded projection. As a result, the pallets holding the containers can be stacked for easier transportation to an operation that fills, caps and then cools the filled containers.

As shown in FIG. 1B, the blow-molded containers may be smooth cylinders on the outside without the vacuum compression panels previously considered necessary on the side of the container, which detracted from the sleek appearance of the container and provided recesses for gathering product or ice water. These blow-molded containers are preferably made of plastic, such as a thermoplastic polyester resin, for example PET (polyethylene terephthalate) or polyolefins, such as PP and PE. Each container is blow-molded and formed with an approximately polygonal, circular or oval projection 12 that extends from its base during the initial blow-mold operation. In the exemplary embodiment, the relatively smooth side surface of the container may taper slightly in the mid-section of the container to provide an area to place a label. In another embodiment of such a blow-molded container, the smooth side surface may not be formed with the slight depressed area if the label is printed on the container, for example. Alternatively, the relatively smooth surface may have ornamental features (e.g., textures).

In the case of larger containers (e.g., 64 oz.), a container may be formed with a grip panel on a portion of the cylindrical body of the container. Thus, Applicants envision simplified containers where a substantial portion of the cylindrical body is relatively or completely free of structural geometry. An invertible projection may be formed at the base of the container. The invertible projection may take up most of the vacuum bringing the cooled hot-filled container to its aesthetic appearance. It is envisioned that Mini or supplemental vacuum panels may be necessary to complete the removal of the vacuum in larger containers. These mini or supplemental vacuum panels may be incorporated in the grip panel or at an area that does not interfere with the positioning of a label.

Grip panels are disclosed, for example, in U.S. Pat. Nos. 6,375,025; 5,392,937; 6,390,316; and 5,598,941. Many of the grip panels disclosed in the prior art may also serve as vacuum relief or flex panels. Utilizing the present invention, it is not necessary for the grip panel to act as a vacuum relief panel and the design may therefore be simplified. That is, the ribbed structure associated with the flex panel may not be necessary, or label panel support ribs may be reduced or eliminated. Persons of ordinary skill in the art will be able to modify or simplify known grip panels for use with the present invention.

The base of a blow-molded container, according to one embodiment of the invention, has an inversion or standing ring 14 adjacent a tapered area of the smooth side surface and inside the inversion ring is a substantially smooth projection 12 that extends approximately from a center of the base. The size and shape of the projection 12 depends upon the size and shape of the container that is formed during the blow-molding operation, as well as the contraction properties of the contained product. Prior to leaving the blow-molding operation, the projection may be forced inside the container to provide a relatively flat surface at the container's base, or a stable base for the container. This inversion of the projection 12 extending from the base of the blow-molded container may be accomplished by pneumatic or mechanical means.

Figure 7:
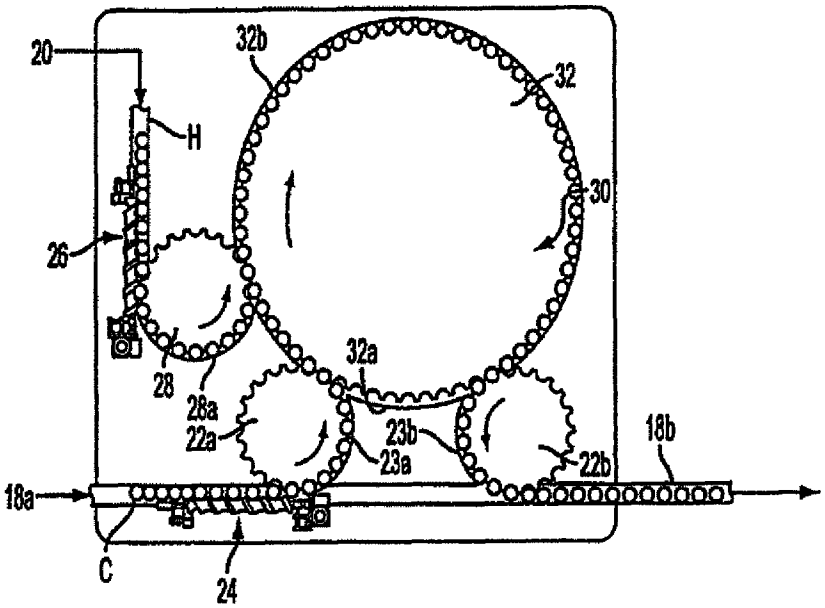
FIG. 7 is a schematic plan view of an exemplary handling system that combines single containers with a container holding device according to the invention.

In this manner, as best seen in FIG. 7, containers C can be conveyed singularly to a combining system that combines container holding devices and containers. The combining system of FIG. 7 includes a container in-feed 18*a* and a container holding device in-feed 20. As will be more fully described below, this system may be one way to stabilize containers with projected bottom portions that are unable to be supported by their bottom surfaces alone. Container in-feed 18*a* includes a feed scroll assembly 24, which feeds and spaces the containers at the appropriate spacing for merging containers C into a feed-in wheel 22*a*. Wheel 22*a* comprises a generally star-shaped wheel, which feeds the containers to a main turret system 30 and includes a stationary or fixed plate 23*a* that supports the respective containers while containers C are fed to turret system 30, where the containers are matched up with a container holding device H and then deactivated to have a projecting bottom portion.

Similarly, container holding devices H are fed in and spaced by a second feed scroll 26, which feeds in and spaces container holding devices H to match the spacing on a second feed-in wheel 28, which also comprises a generally star-shaped wheel. Feed-in wheel 28 similarly includes a fixed plate 28*a* for supporting container holding devices H while they are fed into turret system 30. Container holding devices H are fed into main turret system 30 where containers C are placed in container holding devices H, with holding devices H providing a stable bottom surface for processing the container. In the illustrated embodiment, main turret system 30 rotates in a clock-wise direction to align the respective containers over the container holding devices fed in by star wheel 28: However, it should be understood that the direction of rotation may be changed. Wheels 22*a* and 28 are driven by a motor 29 (FIG. 8), which is drivingly coupled, for example, by a belt or chain or the like, to gears or sheaves mounted on the respective shafts of wheels 22*a* and 28.

Container holding devices H comprise disc-shaped members with a first recess with an upwardly facing opening for receiving the lower end of a container and a second recess with downwardly facing opening, which extends upwardly from the downwardly facing side of the disc-shaped member through to the first recess to form a transverse passage through the disc-shaped member. The second recess is smaller in diameter than the first so as to form a shelf in the disc-shaped member on which at least the perimeter of the container can rest. As noted above, when a container is deactivated, its vacuum panels will be extended or projecting from the bottom surface. The extended or projecting portion is accommodated by the second recess. In addition, the containers can then be activated through the transverse passage formed by the second recess, as will be appreciated more fully in reference to FIGS. 5A-C and 12-13 described below.

In order to provide extra volume and accommodation of pressure changes needed when the containers are filled with a hot product, such as a hot liquid or a partly solid product, the inverted projection of the blow-molded containers should be pushed back out of the container (deactivated). For example, a mechanical operation employing a rod that enters the neck of the blow-molded container and pushes against the inverted projection of the blow-molded container causing the inverted projection to move out and project from the bottom of the base, as shown in FIGS. 1B, 5C and 12-13. Alternatively, other methods of deploying the inverted projection disposed inside a blow-molded container, such as injecting pressurized air into the blow-molded container, may be used to force the inverted projection outside of the container. Thus, in this embodiment, the blow-molded projection is initially inverted inside the container and then, a repositioning operation pushes the inverted projection so that it projects out of the container.

Figure 8:
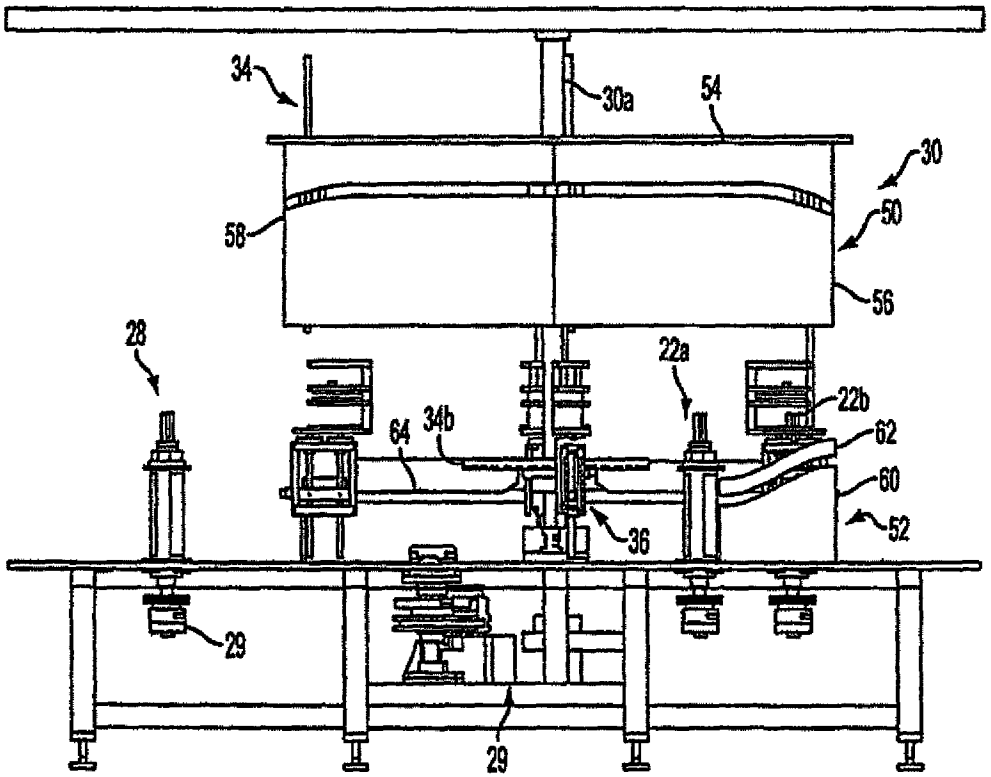
FIG. 8 is a front side elevation view of the handling system of FIG. 7.
Figure 9:
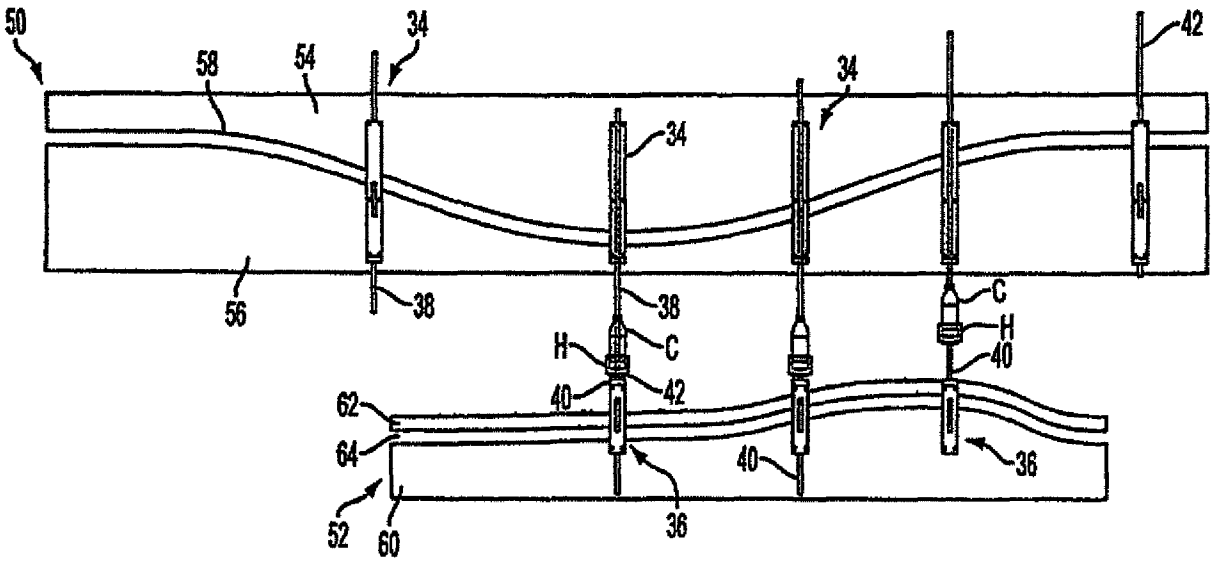
FIG. 9 is an unfolded elevation view of a section of the combining portion of the handling system of FIG. 8 illustrating the movement of the actuators.

Referring to FIG. 8, main turret system 30 includes a central shaft 30*a*, which supports a container carrier wheel 32, a plurality of radially spaced container actuator assemblies 34 and, further, a plurality of radially spaced container holder actuator assemblies 36 (FIG. 9). Actuator assemblies 34 deactivate the containers (extend the inverted projection outside the bottom surface of the container), while actuator assemblies 36 support the container holding devices and containers. Shaft 30*a* is also driven by motor 29, which is coupled to a gear or sheave mounted to shaft 30*a* by a belt or chain or the like. In addition, main turret system 30 includes a fixed plate 32*a* for supporting the containers as they are fed into container carrier wheel 32. However, fixed plate 32*a* terminates adjacent the feed-in point of the container holding devices so that the containers can be placed or dropped into the container holding devices under the force of gravity, for example. Container holding devices H are then supported on a rotating plate 32*b*, which rotates and conveys container holding devices H to discharge wheel 22*b*, which thereafter feeds the container holding devices and containers to a conveyor 18*b*, which conveys the container holding devices and containers to a filling system. Rotating plate 321) includes openings or is perforated so that the extendable rods of the actuator assemblies 36, which rotate with the rotating plate, may extend through the rotating plate to raise the container holding devices and containers and feed the container holding devices and containers to a fixed plate or platform 23*b* for feeding to discharge wheel 22*b*.

As best seen in FIG. 9, each actuator assembly 34, 36 is positioned to align with a respective container C and container holding device IL Each actuator assembly 34 includes an extendable rod 38 for deactivating containers C, as will be described below. Each actuator assembly 36 also includes an extendable rod 40 and a pusher member 42, which supports a container holding device, while a container C is dropped into the container holding device H and, further supports the container holding device H while the container is deactivated by extendable rod 38. To deactivate a container, actuator assembly 34 is actuated to extend its extendable rod 38 so that it extends into the container C and applies a downward force onto the invertible projection (12) of the container to thereby move the projection to an extended position to increase the volume of container C for the hot-filling and post-cooling process that follows (FIG. 1B). After rod 38 has fully extended the invertible projection of a container, rod 38 is retracted so that the container holding device and container may be conveyed for further processing.

Again as best seen in FIG. 9, while rod 38 is retracted, extendable rod 40 of actuator 36 is further extended to raise the container holding device and container to an elevation for placement on fixed plate or platform 23*b* of discharge wheel 22*b*. Wheel 22*b* feeds the container holding device and container to an adjacent conveyor 18*b*, which conveys the container holding device and container to filling portion 16 of the container processing system. Discharge wheel 22*b* is similar driven by motor 29, which is coupled to a gear or sheave mounted on its respective shaft.

Referring again to FIGS. 8 and 9, main turret assembly 30 includes an upper cam assembly 50 and a lower cam assembly 52. Cam assemblies 50 and 52 comprise annular cam plates that encircle shaft 30*a* and actuator assemblies 34 and 36. The cam plates provide cam surfaces to actuate the actuator assemblies, as will be more fully described below. Upper cam assembly 50 includes upper cam plate 54 and a lower cam plate 56, which define there between a cam surface or groove 58 for guiding the respective extendable rods 38 of actuator assemblies 34. Similarly, lower cam assembly 52 includes a lower cam plate 60 and an upper cam plate 62 which define there between a cam surface or groove 64 for guiding extendable rods 40 of actuator assemblies 36. Mounted to extendable rod 38 may be a guide member or cam follower, which engages cam groove or surface 58 of upper cam assembly 50. As noted previously, actuator assemblies 34 are mounted in a radial arrangement on main turret system 30 and, further, are rotatably mounted such that actuator assemblies 34 rotate with shaft 30*a* and container holder wheel 32. In addition, actuator assemblies 34 may rotate in a manner to be synchronized with the in-feed of containers C. As each of the respective actuator assemblies 34 is rotated about main turret system 30 with a respective container, the cam follower is guided by groove 58 of cam assembly 50, thereby raising and lowering extendable member 38 to deactivate the containers, as previously noted, after the containers are loaded into the container holding devices.

If the container holding devices are not used, the containers according to the invention may be supported at the neck of each container during the filling and capping operations to provide maximum control of the container processes. This may be achieved by rails R, which support the neck of the container, and a traditional cleat and chain drive, or any other known like-conveying modes for moving the containers along the rails R of the production line. The extendable projection 12 may be positioned outside the container C by an actuator as described above.

Figure 2:
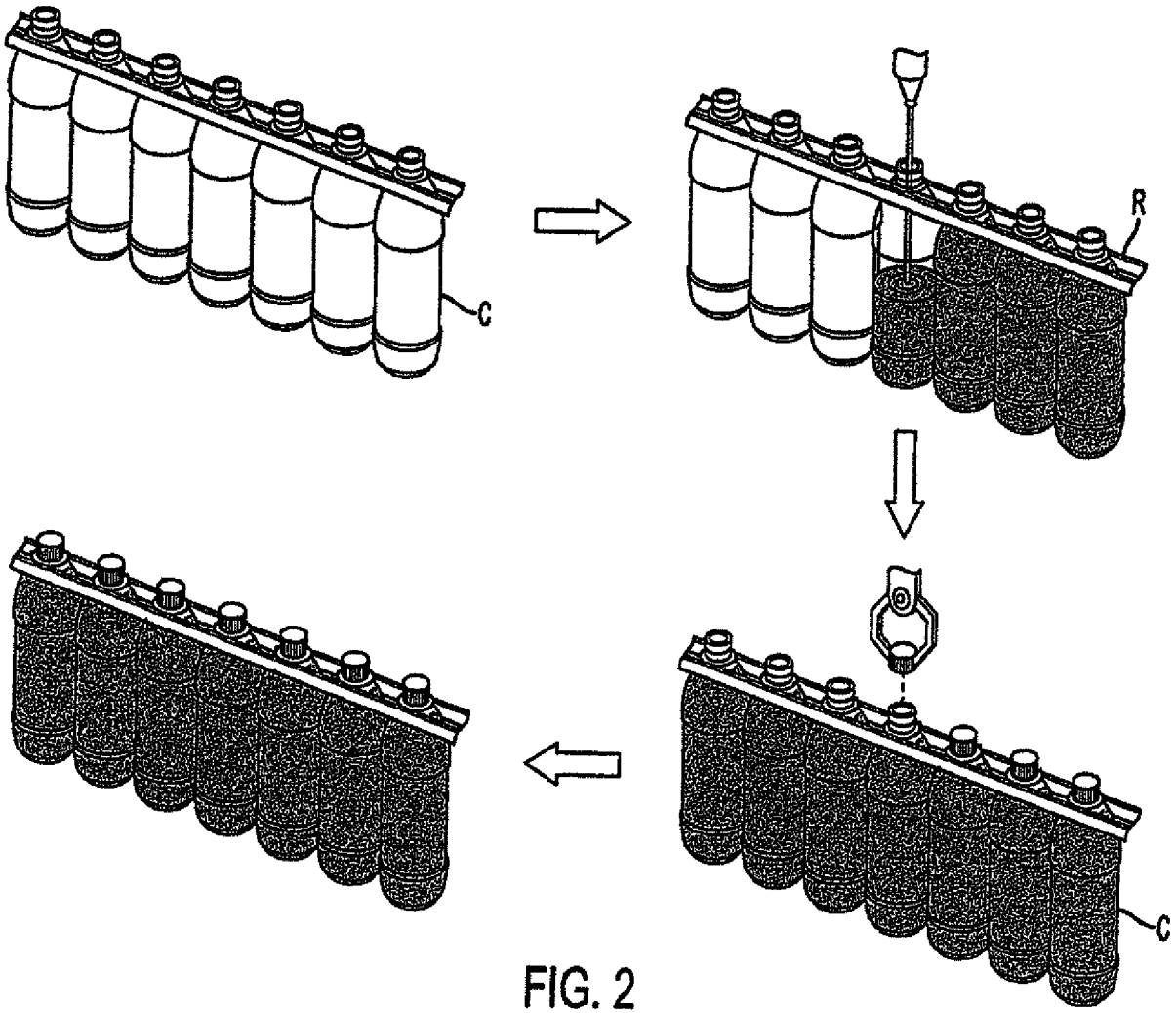
FIG. 2 schematically depicts containers being filled and capped.

The process of repositioning the projection outside of the container preferably should occur right before the filling of the hot product into the container. According to one embodiment of the invention, the neck of a container would be sufficiently supported by rails so that the repositioning operation could force or pop the inverted base outside of the container without causing the container to fall off the rail conveyor system. In some instances, it may not be necessary to invert the projection prior to leaving the blow-molding operation and these containers are moved directly to a filling station. The container with an extended projection, still supported by its neck, may be moved by a traditional neck rail drive to the filling and capping operations, as schematically shown in FIG. 2.

Figure 3B:
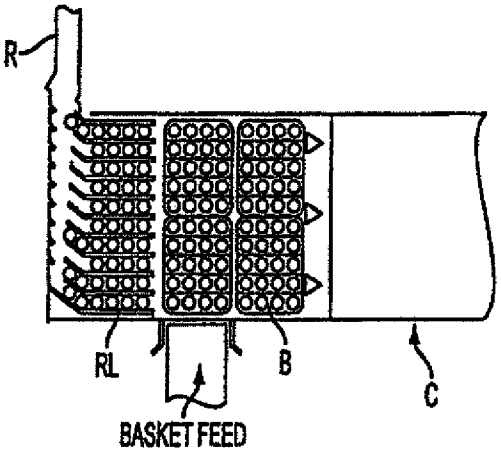
FIGS. 3A and B depict exemplary channeling of containers into baskets or racks according to the present invention for the cooling operation.
Figure 3A:
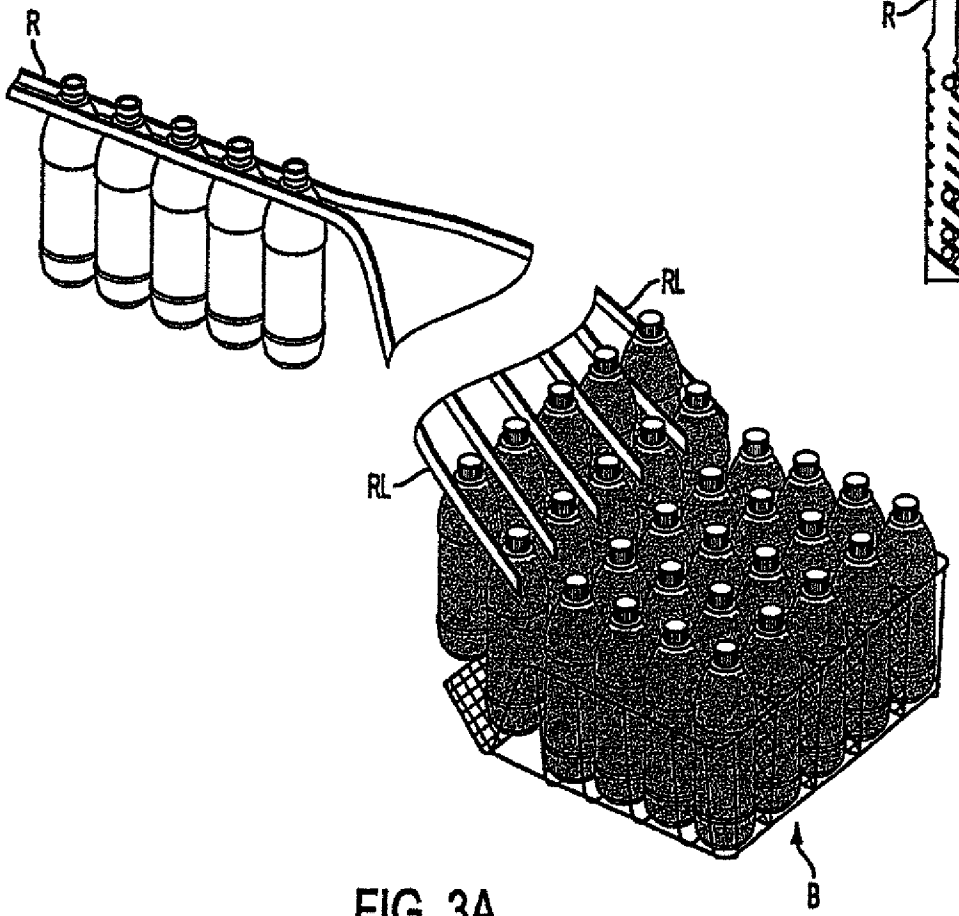

As shown in FIG. 3A, the system for conveying the filled containers may include dividing the single filling and capping rail R into a plurality of rail lanes RL that feed into a shuttle basket B or rack system. The continuous batch mode handling of the containers into the cooling baskets or racks provides total control of the containers/package throughout the cooling cycle. As shown in FIG. 3B, baskets or racks are mechanically fed into a lane where the basket or rack receives hot-filled containers with the extending projections from each of the plurality of rail lanes, until the basket is full. After the basket or rack is full of filled containers, it is moved for example, perpendicularly away from the direction of basket or rack feed toward a cooler. The shuttle basket or rack system may be driven through a traditional container cooler via a cleat and chain drive, for example.

In one embodiment, the basket may have a gate, which swings down from its upward position in order to allow containers C with the extending projection 12 to enter the basket. In that the hot-filled containers have projections extending from their base, the rail lanes and basket may be controlled in a sequence to fill the basket or rack with containers. For example, the basket or rack would have a plurality of openings for receiving respective projections of the hot-filled containers. Either robotic arms and/or the rail lanes would lift a row of hot-filled containers with extending projections over the gate and into respective openings of the basket. The basket would move away from its initial fed position exposing another row of openings for receiving hot-filled containers and then that row would be filled with the containers with the extending projections. This process would continue so that the entire basket could receive hot-filled containers.

The handling of the filled and capped containers with extending projections would also be sequenced so that there would be room underneath the rail lanes to feed the basket or rail. Thus, the basket could be positioned initially so that a container fed down each rail lane could be lifted into a respective opening of the basket. The basket would move to the left, as shown in FIG. 3B, and then the next row of containers would be fed down each rail lane and then lifted into the second row openings of the basket or mil. Alternatively, the basket or racks could be fed into their position and a robotic arm of the rail lanes could pick up each container and place the same in a respective opening of the basket or rack.

Figure 4:
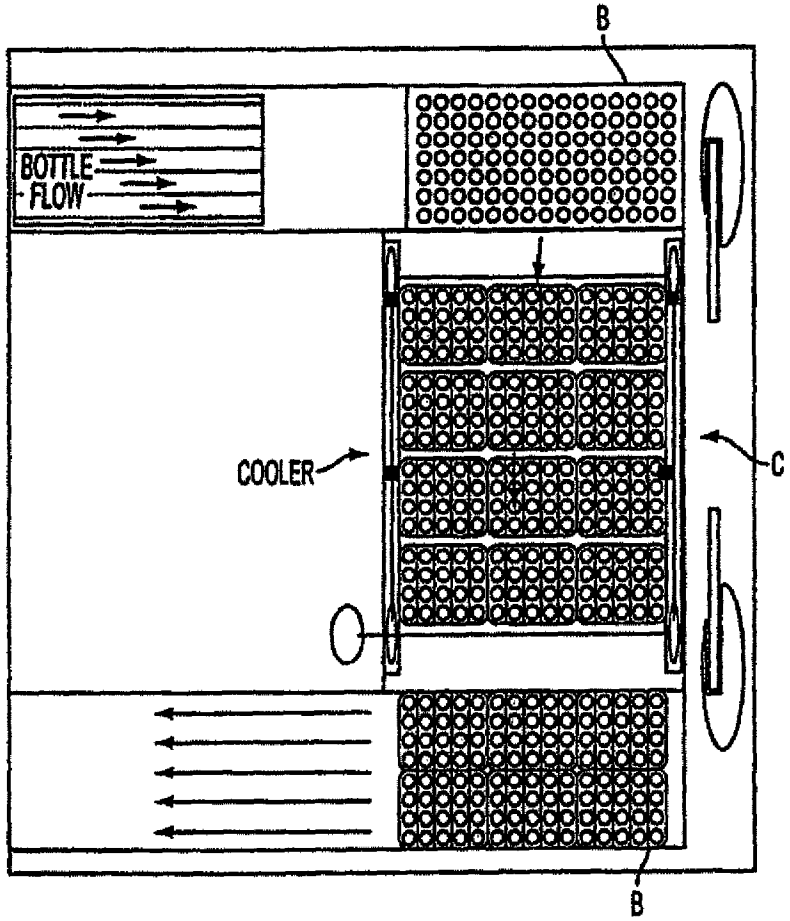
FIG. 4 depicts an exemplary flow of racked containers in a cooler according to the present invention.

After the basket is full of hot-filled containers, the gate would swing upwards and lock onto the side of the basket and then the basket would move toward the cooler C. Thus, according to the invention, the handling system provides lane control to align the containers before they are placed in the basket or rack system. FIG. 4 illustrates how a shuttle basket B or rack system may travel through a traditional cooler, which may have ambient air or coolant blowing against the hot-filled containers to cool their contents to room temperature.

After the containers and their contents have been cooled during the cooling operation, the cooled product has contracted and thus an extra amount of volume exists in these cooled containers. However, the cooling operation also induces a vacuum in each container which distorts each container thereby lessening the amount of volume in the container. Since the projection extending from the base of the container is no longer necessary and a relatively flat base surface is desired, each shuttle basket or rack enters an activation operation, which reforms the containers from the induced vacuum caused by the cooled down contraction of the product within the containers to aesthetic containers. The basket or racks provide location and control of the containers during the activation step at the end of the cooling cycle.

As schematically shown in FIGS. 5A-C, the activation operation is achieved by placing a panel P with a number of projections corresponding to the projections extending from the containers underneath a container-filled basket B or rack. The panel and projections may rest underneath a single row or column of the containers in the basket or rack. Or, the panel and associated projections may be larger extending over two or more row or columns. An arm or cover (not shown) is placed over the containers to be activated. Then, the panel is moved upward towards the projections with sufficient force to push the projections back to their inverted position inside a respective container, like a traditional push-up. Thus, the extending projection is moved back inside the container body or re-inverted inside the container. The arm or cover placed over the containers holds the containers in place when the force of the activator panel is applied against the containers. It is envisioned that a panel the size of the basket or rack and with respective projections that extend to each of the openings of the basket or rack could invert the projecting base of the container inside each opening in the basket or rack, if the force applied to the panel is sufficient to pop the projecting bases back into the container.

Figure 6:
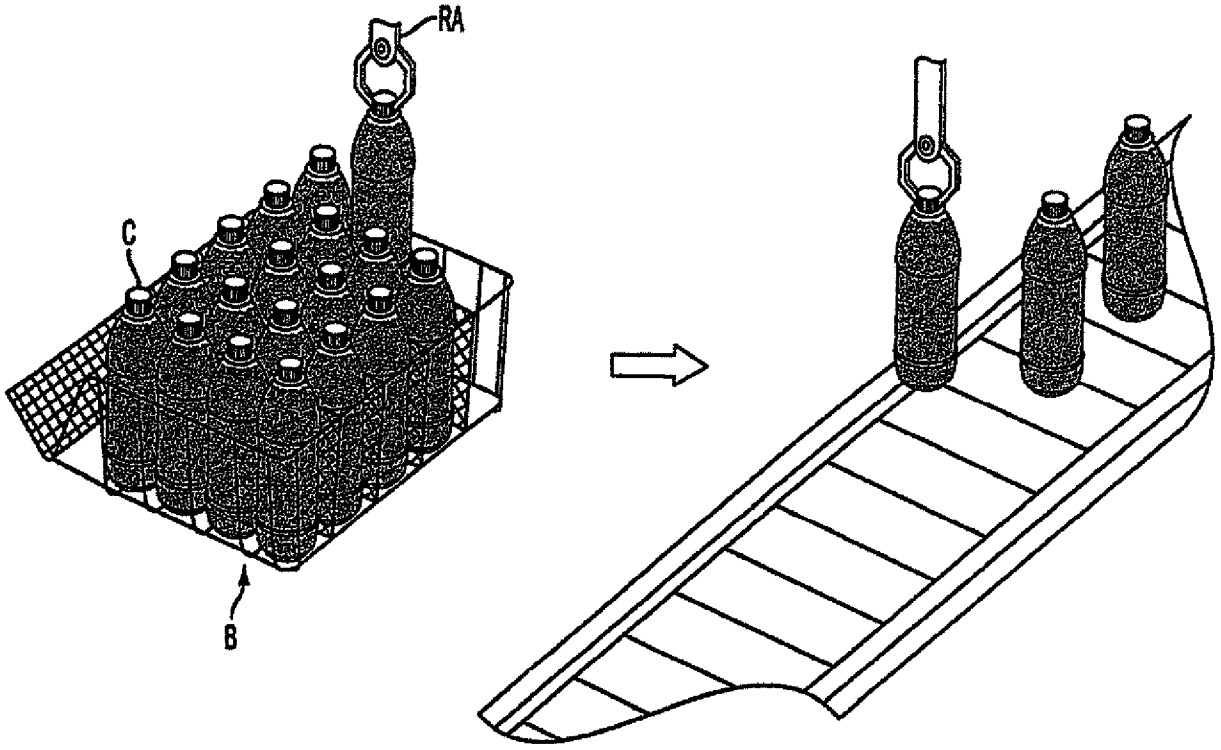
FIG. 6 schematically depicts an exemplary embodiment of containers exiting the cooling operation, after the activation operation according to the present invention.

In an exemplary embodiment, the activation step would occur at the end of the cooling cycle and would absorb or counter the vacuum created during the cooling of the hot product. Once the base projections have been re-inverted so that each base surface is relatively flat, the containers may be unloaded from the basket or racks that shuttle the containers through the cooler. As schematically shown in FIG. 6, at the cooling exit, a robotic arm RA may lift the containers at their capped neck vertically upwards and then out of the basket B or rack. The containers with the inverted bases would then be released from the robotic arm and sent down another conveying line like a normally filled bottle or container. The conveying line could be an in-line rail belt or could be an in-line conveying system using air to control the movement of the containers. The conveying line may feed the containers to a labeling operation and then to a packaging operation where the containers are loaded into cases for shipping to a grocery store or the like.

In an alternative operation, it is envisioned that containers would continue along the production line from the filling station, the capping station and through a cooling station. That is, instead of queuing up the containers for placement in a basket or rack for the cooling operation, each container would move along a production conveyor line. After each container passed through a cooling station, an activator would force the projecting base into the interior of the container. In a similar alternative embodiment where containers are individually passed through the cooling station, the cooled containers are then re-inverted as previously described. Then, the activated containers could be placed in conventional baskets or racks.

Figure 10:
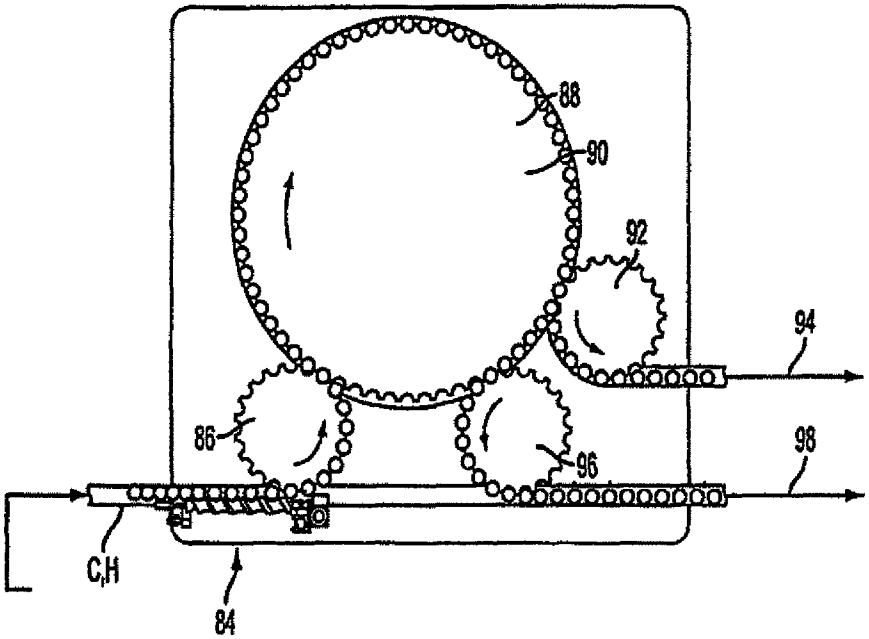
FIG. 10 is a schematic plan view of a second embodiment of an activation portion of the handling system of the present invention.
Figure 11:
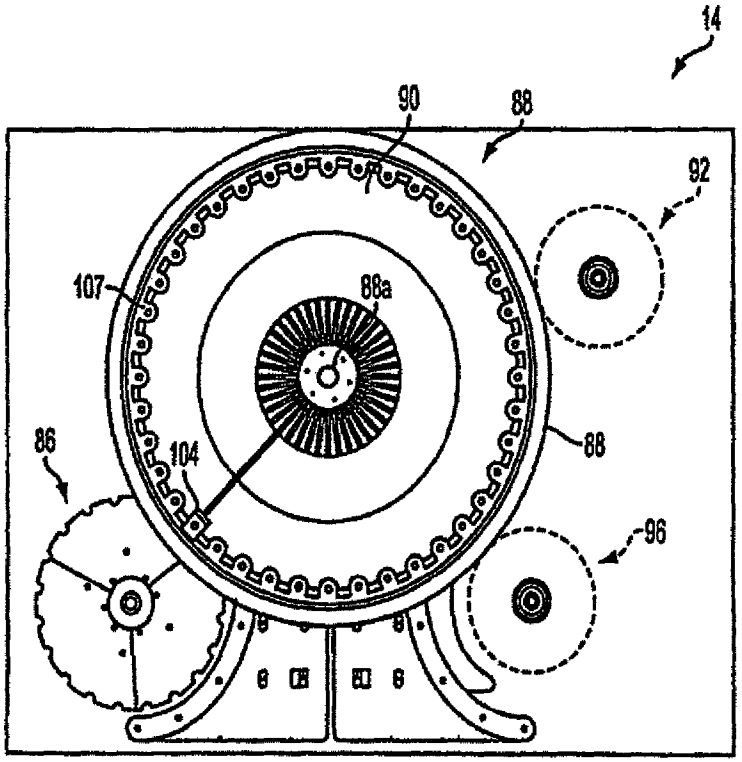
FIG. 11 is a detailed plan view of the activation portion of the handling system of FIG. 10.

Referring to FIGS. 10 and 11, one system for singularly activating containers C includes a feed-in scroll assembly 84, which feeds and, further, spaces the respective container holding devices and their containers at a spacing appropriate for feeding into a feed-in wheel 86. Feed-in wheel 86 is of similar construction to wheel 22*b* and includes a generally star-shaped wheel that feeds-in the container holders and containers to turret assembly 88. Turret assembly 88 is of similar construction to turret assembly 30 and includes a container holder wheel 90 for guiding and moving container holding devices H and containers C in a circular path and, further, a plurality of actuator assemblies 104 and 106 for removing the containers from the container holders and for activating the respective containers, as will be more fully described below. After the respective containers have been activated and the respective containers removed from the container holding devices, the holders are discharged by a discharge wheel 92 to conveyor 94 and the containers are discharged by a discharge wheel 96 to a conveyor 98 for further processing. Wheels 86, 92, and 96 may be driven by a common motor, which is drivingly coupled to gears or sheaves mounted to the respective shafts of wheels 86, 92, and 96.

As previously noted, turret assembly 88 is of similar construction to turret assembly 30 and includes container holder wheel 90, upper and lower cam assemblies 100 and 102, respectively, a plurality of actuator assemblies 104 for griping the containers, and a plurality of actuator assemblies 106 for activating the containers. In addition, turret system 88 includes a support plate 107, which supports the container holders and containers as they are moved by turret system 88. As best seen in FIG. 11, container holder wheel 90, actuator assemblies 104, actuator assemblies 106, and plate 107 are commonly mounted to shaft 88*a* so that they rotate in unison. Shaft 88*a* is similarly driven by the common motor, which is drivingly coupled to a gear or sheave mounted on shaft 88*a*.

Figure 12:
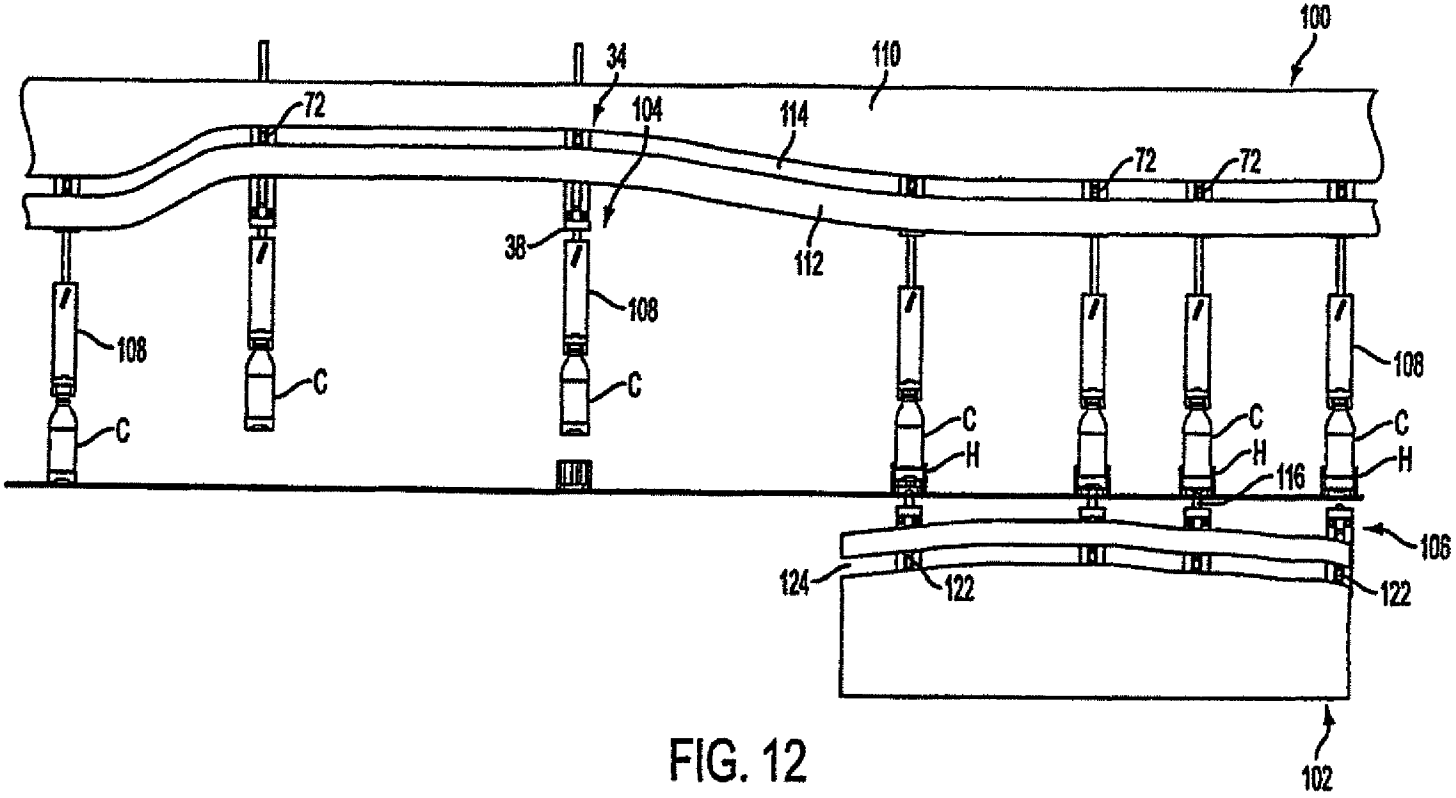
FIG. 12 is an unfolded elevation view of a section of the activation portion of FIG. 10 illustrating the activation of the container and the removal of the container from the container holding device.
Figure 13:
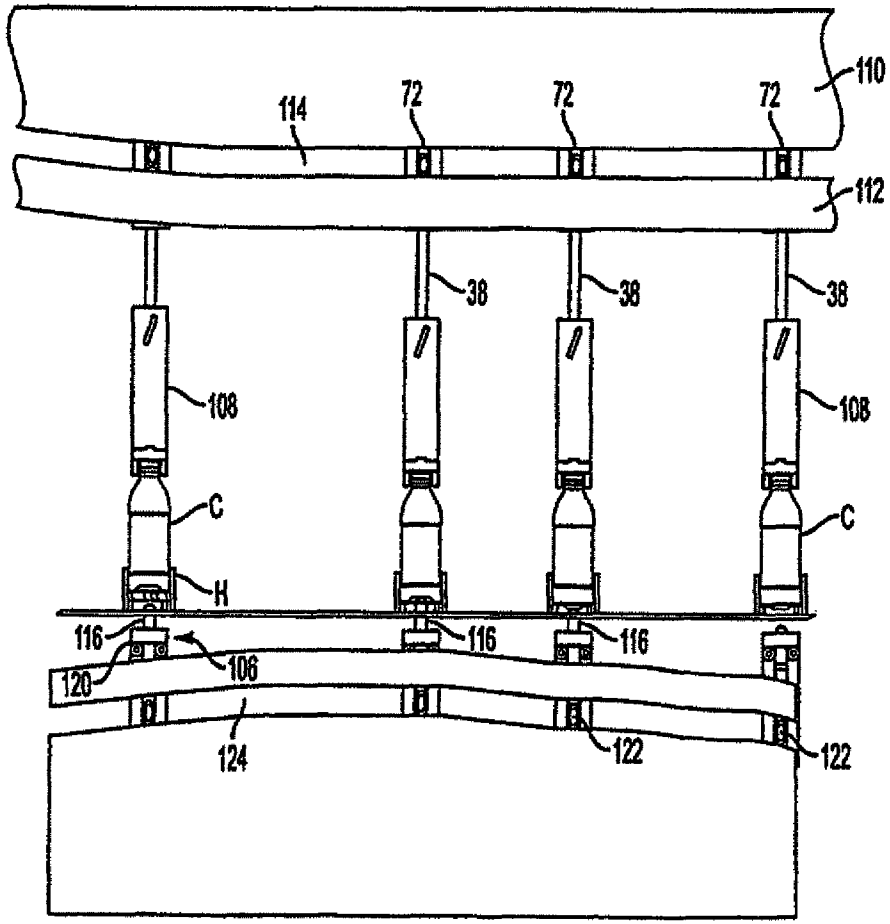
FIG. 13 is an enlarged view of a section of the activation portion of FIG. 12.
Figure 14:
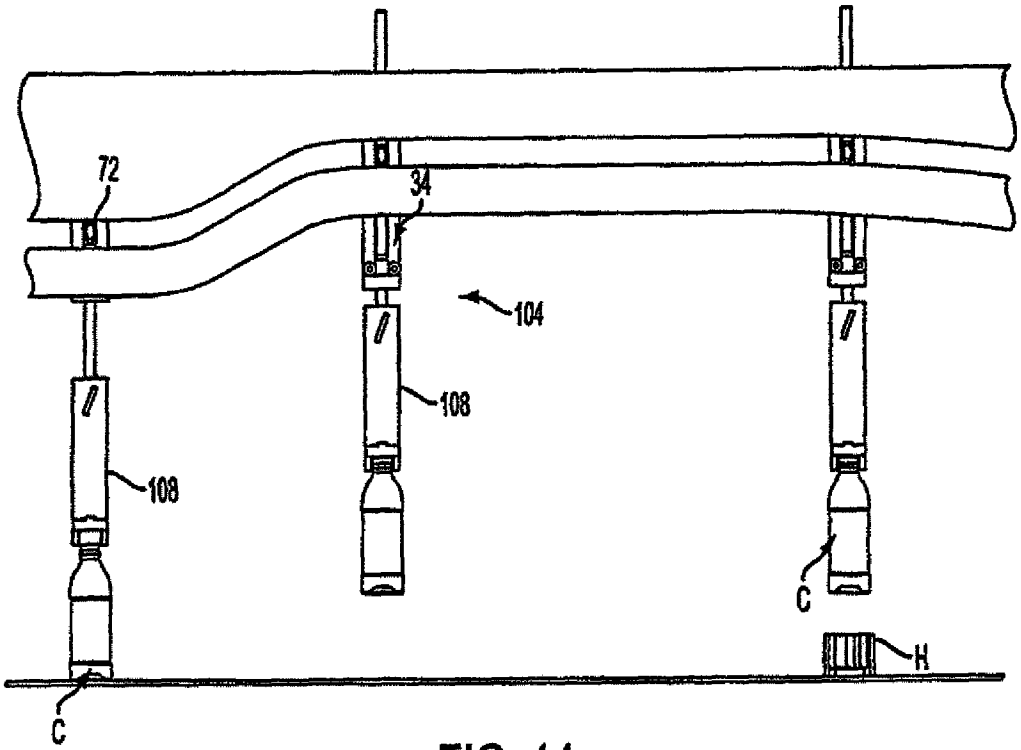
FIG. 14 is an enlarged view of the container holder removal section of FIG. 12.

Looking at FIGS. 12-14, actuator assemblies 104 and 106 are similarly controlled by upper and lower cam assemblies 100 and 102, to remove the containers C from the container holding devices II and activate the respective containers so that the containers generally assume their normal geometrically stable configuration wherein the containers can be supported from their bottom surfaces and be conveyed on a conventional conveyor. Referring to FIG. 12, each actuator assembly 104 includes actuator assembly 34 and a container gripper 108 that is mounted to the extendable rod 38 of actuator assembly 34. As would be understood, grippers 108 are, therefore, extended or retracted with the extension or retraction of extendable rods 38, which is controlled by upper cam assembly 100.

Similar to upper cam assembly 50, upper cam assembly 100 includes an upper plate 110 and a lower plate 112, which define therebetween a cam surface or recess 114, which guides guide members 72 of actuator assemblies 104 to thereby extend and retract extendable rods 38 and in turn to extend and retract container grippers 108. As the containers are conveyed through turret assembly 88, a respective gripper 108 is lowered onto a respective container by its respective extendable rod 38. Once the gripper is positioned on the respective container, actuator assemblies 106 are then actuated to extend their respective extendable rods 116, which extend through plate 107 and holders H, to apply a compressive force onto the invertible projections of the containers to move the projections to their recessed or retracted positions to thereby activate the containers. As would be understood, the upward force generated by extendable rod 116 is counteracted by the downward force of a gripper 108 on container C. After the activation of each container is complete, the container then can be removed from the holder by its respective gripper 108.

Referring to FIGS. 12-13, each actuator assembly 106 is of similar construction to actuator assemblies 34 and 36 and includes a housing 120, which supports extendable rod 116. Similar to the extendable rods of actuator assemblies 34 and 36, extendable rod 116 includes mounted thereto a guide 122, which engages the cam surface or recess 124 of lower cam assembly 102. In this manner, guide member 122 extends and retracts extendable rod 116 as it follows cam surface 124 through turret assembly 88. As noted previously, when extendable rod 116 is extended, it passes through the base of container holding device H to extend and contact the lower surface of container C and, further, to apply a force sufficient to compress or move the invertible projection its retracted position so that container C can again resume its geometrically stable configuration for normal handling or processing.

The physics of manipulating the activation panel P or extendable rod 116 is a calculated science recognizing 1) Headspace in a container; 2) Product density in a hot-filled container; 3) Thermal differences from the fill temperature through the cooler temperature through the ambient storage temperature and finally the refrigerated temperature; and 4) Water vapor transmission. By recognizing all of these factors, the size and travel of the activation panel P or extendable rod 116 is calculated so as to achieve predictable and repeatable results. With the vacuum removed from the hot-filled container, the container can be light-weighted because the need to add weight to resist a vacuum or to build vacuum panels is no longer necessary. Weight reduction of a container can be anticipated to be approximately 10%.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. A hot-fillable plastic container comprising:

a threaded neck portion configured to receive a threaded cap to sealingly enclose a product hot-filled into the plastic container;

a body portion including a dome portion adjacent the threaded neck portion, a first label stop portion adjacent the dome portion, a second label stop portion, a sidewall between the first and second label stop portions to accommodate placement of a label, a supplemental vacuum panel formed in the sidewall and configured to remove a first portion of an induced vacuum created within the plastic container in response to cooling after the plastic container is hot-filled and capped; and a base portion including a standing surface for conveyance of the plastic container on a flat surface and having a moveable element arranged at a bottom end thereof, the moveable element of the base portion being configured to move from a first initial pre-filling position to a second position in response to a selectively-applied pushing force to remove a second portion of the vacuum, the second position being more toward an interior of the plastic container than the first initial pre-filling position, wherein the first portion of the vacuum and the second portion of the vacuum constitute substantially the entire vacuum.

2. The hot-fillable plastic container according to claim 1, wherein the moveable element is configured to remain in the first initial pre-filling position until the selectively-applied pushing force is sufficient to move the moveable element from the first initial pre-filling position to the second position.

3. The hot-fillable plastic container according to claim 1, wherein the plastic container is configured such that the moveable element in the first initial pre-filling position extends below the standing surface of the plastic container during hot-filling, capping, and cooling of the plastic container.

4. The hot-fillable plastic container according to claim 1, wherein the plastic container is configured to be conveyed by the standing surface thereof on a flat surface with the moveable element not extending below the standing surface.

5. The hot-fillable plastic container according to claim 1, wherein the body portion of the plastic container is free of surface features other than said supplemental vacuum panel that removes the first portion of the vacuum.

6. The hot-fillable plastic container according to claim 1, wherein the supplemental vacuum panel is defined in a grip panel in the body portion of the plastic container.

7. The hot-fillable plastic container according to claim 1, wherein the standing surface of the plastic container is separate from the moveable element and supports the plastic container during one or more of hot-filling, capping, creating a vacuum and removing the first portion of the vacuum.

8. The hot-fillable plastic container according to claim 1, wherein the supplemental vacuum panel removes the first portion of the vacuum by deflection of the supplemental vacuum panel.

9. The hot-fillable plastic container according to claim 1, wherein the first initial pre-filling position extends below the standing surface and the second position extends above the standing surface.

10. The hot-fillable plastic container according to claim 1, wherein a projection including at least a portion of the moveable element extends below the standing surface of the plastic container in the first initial pre-filling position.

11. The hot-fillable plastic container according to claim 10, wherein the projection includes the entire moveable element.

12. The hot-fillable plastic container according to claim 1, wherein the vacuum created in the hot-filled and capped plastic container causes distortion of the plastic container, and removing the vacuum forms the plastic container to a desired shape.

13. The hot-fillable plastic container according to claim 1, wherein the second portion of the vacuum comprises most of the entire vacuum.

14. The hot-fillable plastic container according to claim 1, wherein the supplemental vacuum panel does not interfere with positioning of a label proximate the sidewall.

* * * * *